US011078054B2

(12) United States Patent
Tsuboi

(10) Patent No.: US 11,078,054 B2
(45) Date of Patent: Aug. 3, 2021

(54) CRANE

(71) Applicant: SUMITOMO HEAVY INDUSTRIES CONSTRUCTION CRANES CO., LTD., Tokyo (JP)

(72) Inventor: Takayuki Tsuboi, Aichi (JP)

(73) Assignee: SUMITOMO HEAVY INDUSTRIES CONSTRUCTION CRANES CO., LTD., Tokyo (JP)

( * ) Notice: Subject to any disclaimer, the term of this patent is extended or adjusted under 35 U.S.C. 154(b) by 135 days.

(21) Appl. No.: 16/406,617

(22) Filed: May 8, 2019

(65) Prior Publication Data

US 2019/0345008 A1 Nov. 14, 2019

(30) Foreign Application Priority Data

May 9, 2018 (JP) ..... JP2018-090678

(51) Int. Cl.

| | |
|---|---|
| ***B66C 23/92*** | (2006.01) |
| ***B66C 23/06*** | (2006.01) |
| ***B66C 23/90*** | (2006.01) |
| ***B66C 13/22*** | (2006.01) |
| ***B66C 23/36*** | (2006.01) |

(52) U.S. Cl.

CPC ..... *B66C 13/22* (2013.01); *B66C 23/36* (2013.01); *B66C 23/905* (2013.01); *B66C 23/92* (2013.01)

(58) Field of Classification Search

CPC ..... B66C 13/16; B66C 13/22; B66C 23/06; B66C 23/36; B66C 23/905; B66C 23/92

See application file for complete search history.

(56) References Cited

U.S. PATENT DOCUMENTS

2010/0294736 A1* 11/2010 Wernecke ..... F16F 9/061 212/293
2018/0179030 A1* 6/2018 Nysse ..... B66C 13/16
2019/0225465 A1* 7/2019 Koizumi ..... F16F 9/3278

FOREIGN PATENT DOCUMENTS

CN 2801750 Y 8/2006
CN 201 647 862 U 12/2010
CN 104 692 267 B 9/2016

(Continued)

OTHER PUBLICATIONS

Attached Machine Translation for JP2017145132A. (Year: 2017).*
Search Report issued in European Patent Application No. 19171501.0, dated Oct. 17, 2019.

*Primary Examiner* — Michael R Mansen
*Assistant Examiner* — Juan J Campos, Jr.
(74) *Attorney, Agent, or Firm* — Michael Best & Friedrich LLP

(57) ABSTRACT

There is provided a crane including a front member capable of derricking, a backstop disposed on a rear surface side of the front member so as to limit a standing operation of the front member, an angle sensor that detects an angle of the front member, an operation detection unit that detects whether or not the backstop is operated, and a controller that controls a derricking operation of the front member. In a case where the controller determines that the angle of the front member is equal to or larger than a predetermined angle, based on a detection signal output from the angle sensor, and determines that the backstop is not operated, based on a detection signal output from the operation detection unit, the controller stops the standing operation of the front member.

11 Claims, 24 Drawing Sheets

205A

| JIB ANGLE $\theta$ | LIMIT SWITCH 91L | LIMIT SWITCH 91R | OPERATION DETERMINATION |
|---|---|---|---|
| $\theta < 65^\circ$ | OFF | OFF | NORMAL |
| $\theta \geq 65^\circ$ | ON | ON | NORMAL |
| $\theta \geq 65^\circ$ | ON | OFF | ABNORMAL |
| $\theta \geq 65^\circ$ | OFF | ON | ABNORMAL |
| $\theta \geq 65^\circ$ | OFF | OFF | ABNORMAL |

(56) References Cited

FOREIGN PATENT DOCUMENTS

| | | | |
|---|---|---|---|
| JP | 2005-298088 | A | 10/2005 |
| JP | 2017-145132 | A | 8/2017 |

* cited by examiner

FIG. 13

205A

| JIB ANGLE $\theta$ | LIMIT SWITCH 91L | LIMIT SWITCH 91R | OPERATION DETERMINATION |
|---|---|---|---|
| $\theta < 65^\circ$ | OFF | OFF | NORMAL |
| $\theta \geq 65^\circ$ | ON | ON | NORMAL |
| $\theta \geq 65^\circ$ | ON | OFF | ABNORMAL |
| $\theta \geq 65^\circ$ | OFF | ON | ABNORMAL |
| $\theta \geq 65^\circ$ | OFF | OFF | ABNORMAL |

FIG. 25

205E

| JIB ANGLE $\theta$ | LIMIT SWITCH 591L | LIMIT SWITCH 591R | OPERATION DETERMINATION |
|---|---|---|---|
| $\theta < 65^\circ$ | OFF | OFF | NORMAL |
| $\theta \geq 65^\circ$ | ON | ON | NORMAL |
| $\theta \geq 65^\circ$ | ON | OFF | ABNORMAL |
| $\theta \geq 65^\circ$ | OFF | ON | ABNORMAL |
| $\theta \geq 65^\circ$ | OFF | OFF | ABNORMAL |

CRANE

RELATED APPLICATIONS

The contents of Japanese Patent Application No. 2018-090678, filed May 9, 2018, on the basis of which priority benefits are claimed in an accompanying application data sheet, is in its entirety incorporated herein by reference.

BACKGROUND

Technical Field

Certain embodiments of the present invention relate to a crane including a backstop.

Description of Related Art

In a crane including a front member such as a boom and jib which are capable of derricking, a backstop which limits a standing operation of the front member is disposed on a rear surface side of the front member, and the backstop prevents the front member from excessively falling rearward. For example, the backstop disclosed in the related art internally has a buffer spring, and the standing operation of the boom is limited by an operation of the buffer spring.

In the related art, the standing operation of the boom can be performed even in a case where the backstop malfunctions. Accordingly, there is room for improvement in safely driving the crane.

SUMMARY

According to an embodiment of the present invention, there is provided a crane including a front member capable of derricking and a backstop disposed on a rear surface side of the front member so as to limit a standing operation of the front member. The crane has an angle sensor that detects an angle of the front member, an operation detection unit that detects whether or not the backstop is operated, and a controller that controls a derricking operation of the front member. In a case where the controller determines that the angle of the front member is equal to or larger than a predetermined angle, based on a detection signal output from the angle sensor, and in a case where the controller determines that the backstop is not operated, based on a detection signal output from the operation detection unit, the controller stops the standing operation of the front member.

The crane according to the embodiment of the present invention can be safely operated when the backstop malfunctions. Objects, configurations, and advantageous effects other than those described above will be clarified by description of the following embodiments.

BRIEF DESCRIPTION OF THE DRAWINGS

FIG. 13 is a configuration diagram of an operation determination table.

FIG. 25 is a configuration diagram of an operation determination table.

DETAILED DESCRIPTION

Figure 1:
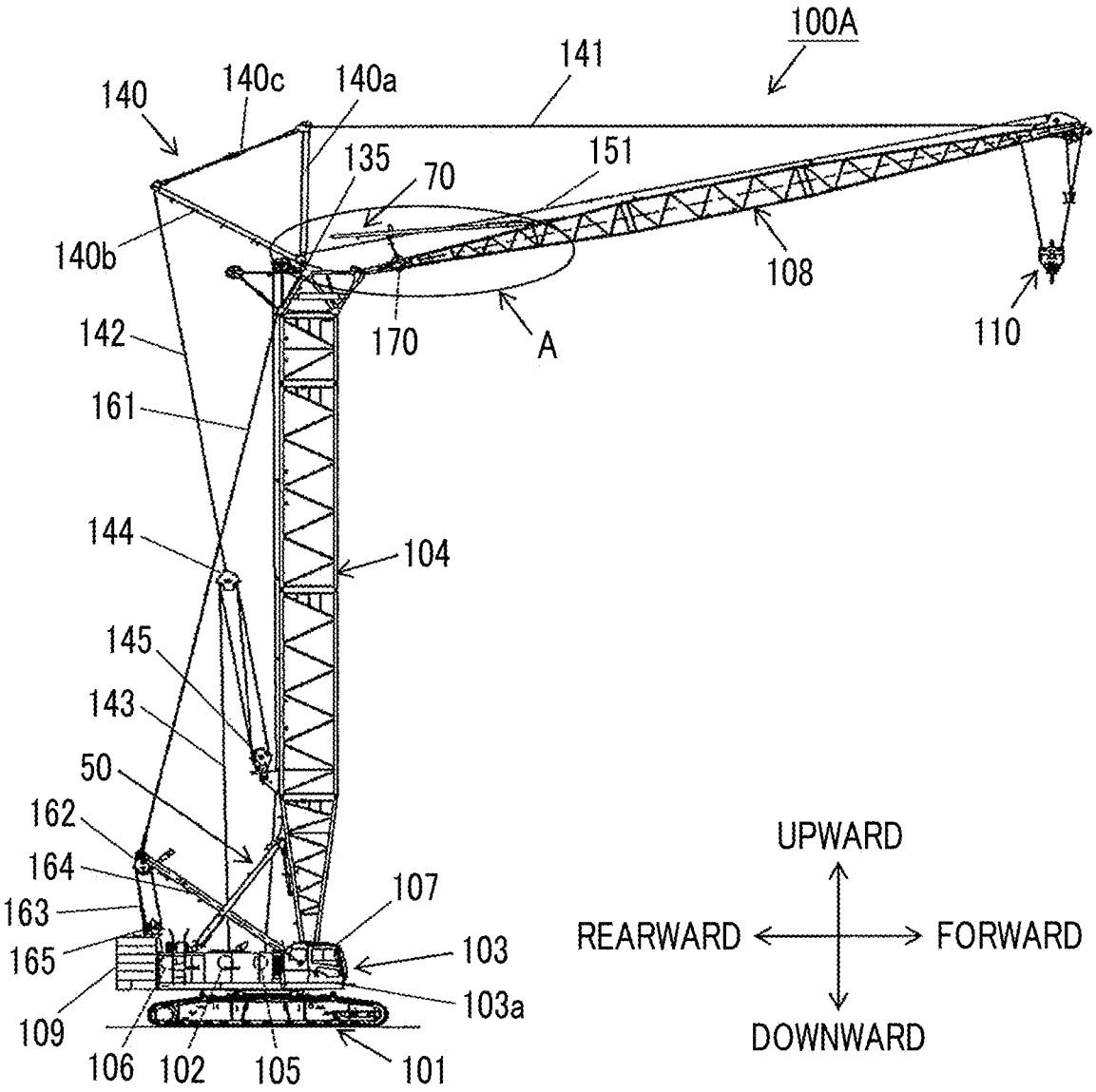
FIG. 1 is a side view illustrating an external configuration of a tower crane according to a first embodiment of the present invention.

It is desirable to provide a crane which can be safely operated in a case where a backstop malfunctions.

Hereinafter, each embodiment of a crane according to the present invention will be described with reference to the drawings. Here, for the sake of convenience of description, forward, rearward, rightward, leftward, upward, and downward directions are defined when viewed from an operator who gets on an operation seat. In addition, in the following description, in a case where the description needs to distinguish a right side and a left side from each other with regard to the same configuration, "L" meaning the left side and "R" meaning the right side will be respectively given to reference numerals corresponding to the configurations so as to distinguish both of these from each other. In the respective embodiments, the same reference numerals will be given to the same configurations, and repeated description will be omitted.

First Embodiment

Overall Configuration of Tower Crane

FIG. 1 is a side view illustrating an external configuration of a tower crane 100A according to a first embodiment of the present invention. The tower crane 100A (hereinafter, abbreviated as the crane 100A) includes a lower traveling body 101, an upper turning body 103 pivotally disposed on the lower traveling body 101 via a turning wheel, a tower boom 104 (hereinafter, abbreviated as the tower 104) serving as a front member whose proximal end portion is pivotally supported by the upper turning body 103, and a jib boom 108 (hereinafter, abbreviated as the jib 108) serving as a front member pivotally supported by a distal end portion of the tower 104. A front part of the upper turning body 103 has an operation room 107, and a counterweight 109 is attached to a rear part of the upper turning body 103. The operation room 107 has an operation lever (not illustrated) for performing various operations and a display device 35 (refer to FIG. 11).

The upper turning body 103 is equipped with a hook winding drum 105 serving as a winch drum for hook winding, a tower derricking drum 106 serving as a winch drum for tower derricking, and a jib derricking drum 102 serving as a winch drum for jib derricking. The hook winding drum 105, the tower derricking drum 106, and the jib derricking drum 102 are respectively driven by hydraulic motors (not illustrated). In addition, in an emergency, a controller 200A transmits a stop signal so as to stop the respective drums 105, 106, and 102 by respectively operating a hook winding stop electromagnetic valve 105*a*, a tower derricking stop electromagnetic valve 106*a*, and a jib derricking stop electromagnetic valve 102*a* (refer to FIG. 11).

A winding rope 151 is wound around the hook winding drum 105, and the winding rope 151 is connected to a hook 110 via a top portion of the tower 104 and a distal end portion of the jib 108. If the hook winding drum 105 is driven, the winding rope 151 is wound or unwound, thereby causing the hook 110 to ascend and descend.

One end of a tower pendant rope 161 is connected to a distal end of the tower 104, and the other end of the tower pendant rope 161 is connected to a tower upper spreader 162. A tower derricking rope 163 is wound around the tower derricking drum 106 by being wrapped multiple times between the tower upper spreader 162 and a tower lower spreader 165 via a top portion of a mast 164. If the tower derricking drum 106 is driven, the tower derricking rope 163 is wound or unwound, thereby changing an interval between the tower lower spreader 165 and the tower upper spreader 162. Accordingly, the tower 104 performs a derricking operation.

A tower strut 140 is pivotally supported by a distal end portion of the tower 104. The tower strut 140 is formed in a triangular shape by using a front strut 140*a*, a rear strut 140*b*, and a connection rod 140*c* which connects the front strut 140*a* and the rear strut 140*b* to each other.

One apex corner portion of the tower strut 140, that is, a distal end portion of the front strut 140*a* is connected to a distal end portion of the jib 108 by using a jib pendant rope 141. The other apex corner portion of the tower strut 140, that is, a distal end portion of the rear strut 140*b* is connected to a jib derricking rope 143 via a tower strut pendant rope 142 and a jib upper spreader 144. The jib derricking rope 143 is wound around the jib derricking drum 102 by being wrapped multiple times between the jib upper spreader 144 and a jib lower spreader 145. If the jib derricking drum 102 is driven, the jib derricking rope 143 is wound or unwound, thereby causing the tower strut 140 to pivot in a forward-rearward direction. Accordingly, the jib 108 performs the derricking operation. A pivot angle of the jib 108 is detected by a jib angle sensor (angle sensor) 170, and a detection signal is output from the jib angle sensor 170 to the controller 200A (refer to FIG. 11).

Tower Backstop

Figure 2:
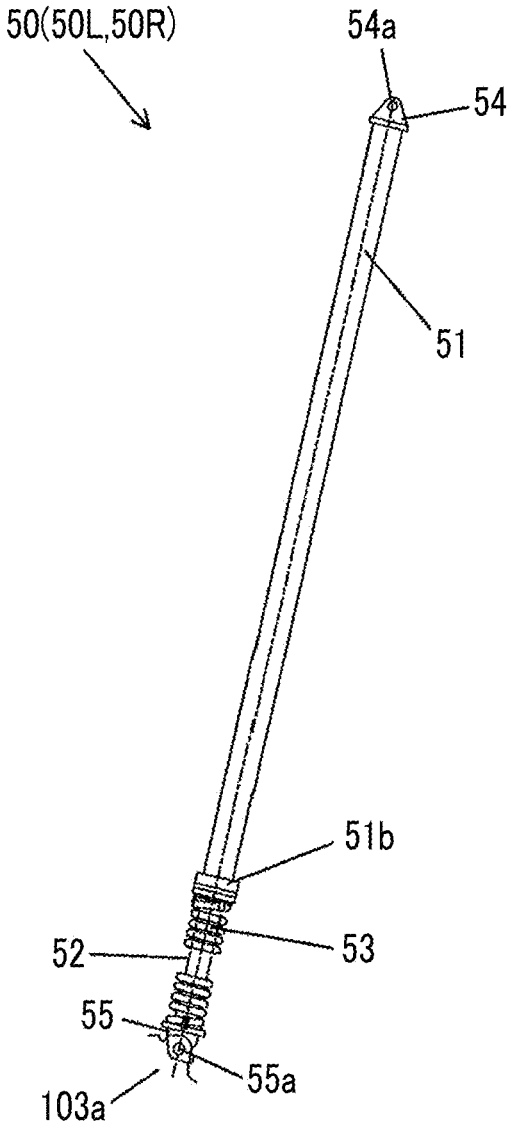
FIG. 2 is a side view of a tower backstop illustrated in FIG. 1.

A pair of right and left tower backstops 50 (50L and 50R) is disposed between a main frame 103*a* of the upper turning body 103 and the tower 104. FIG. 2 is a side view of the tower backstop 50.

The tower backstop 50 limits a pivot range of the tower 104 so that the tower 104 does not pivot at a maximum angle or more. The tower backstop 50 has an outer cylinder 51, an inner cylinder 52, and a compression spring 53. One end of the outer cylinder 51 has an attachment member 54 which is pivotably attached to the tower 104. The attachment member 54 is pivotally supported by a pin 54*a* in a supporting portion (not illustrated) disposed in the tower 104. The inner cylinder 52 is slidably attached to an inner side of the outer cylinder 51. One end of the inner cylinder 52 has a holding member 55 which is pivotably attached to the main frame 103*a*. The holding member 55 is pivotally supported by a pin 55*a* in the main frame 103*a*. The compression spring 53 is inserted into an outer periphery of the inner cylinder 52, and is disposed between the other end portion 51*b* of the outer cylinder 51 and the holding member 55. The compression spring 53 biases the outer cylinder 51 to the tower 104 side (upward in FIG. 2). Although not illustrated in FIG. 2, the main frame 103*a* has a tower backstop limit switch 171 (hereinafter, abbreviated as a limit switch 171) operated in conjunction with a displacement of the outer cylinder 51.

The tower 104 performs a standing operation, and the outer cylinder 51 moves downward while the compression spring 53 is compressed. If the tower 104 stands up at a predetermined angle, a signal is output to the controller 200A via the limit switch 171. The tower derricking stop electromagnetic valve 106*a* is operated, thereby stopping the tower derricking drum 106 (refer to FIG. 11). Therefore, the tower 104 is held at a maximum standing angle. Normally, the maximum standing angle of the tower 104 is approximately 90 degrees.

Jib Backstop

Figure 3:
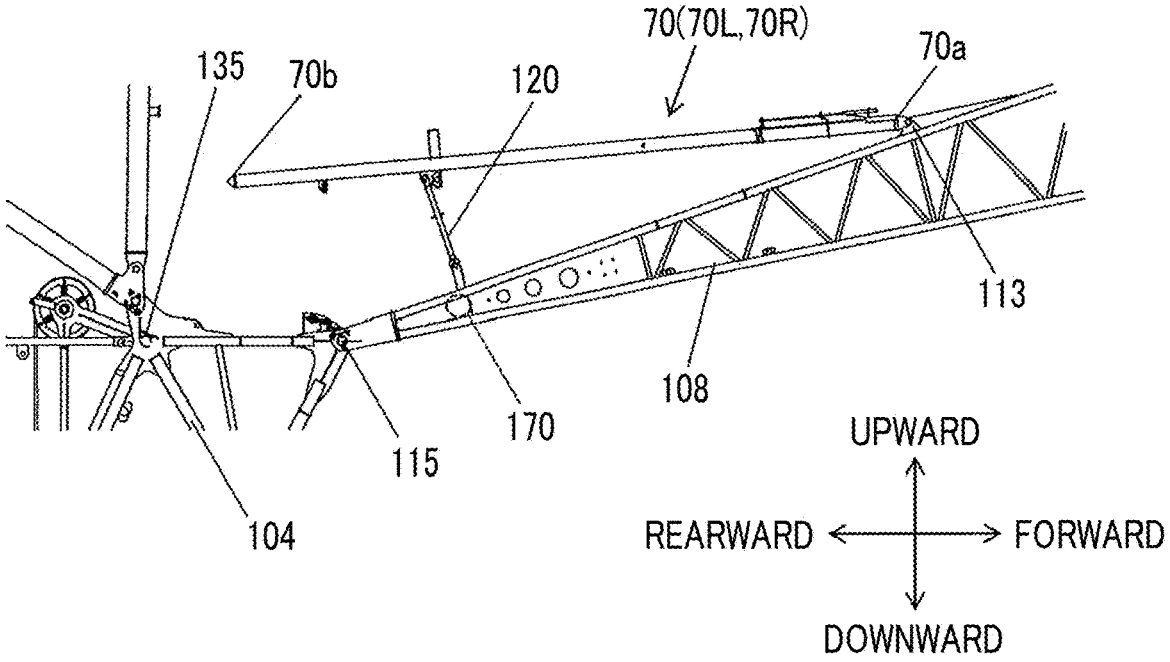
FIG. 3 is an enlarged view of a part A in FIG. 1, and is a side view of a jib backstop.
Figure 4:
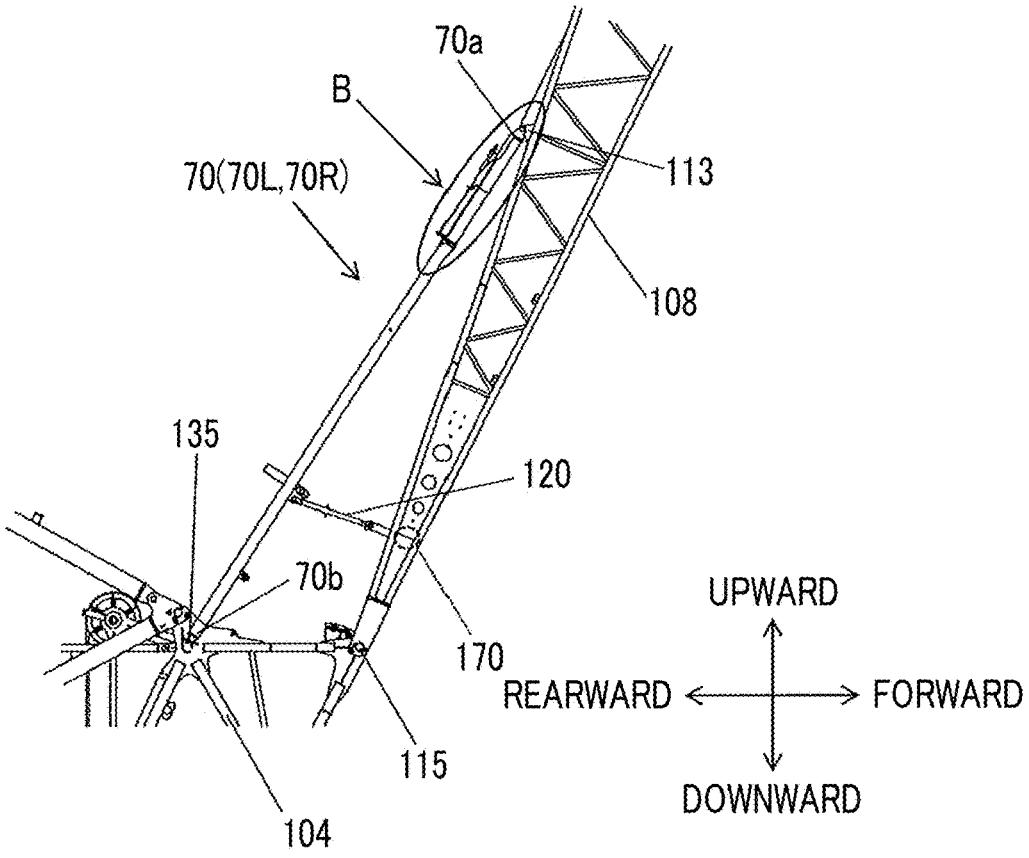
FIG. 4 is a side view of the jib backstop illustrating a state where the other end of the jib backstop is in contact with a target.
Figure 5:
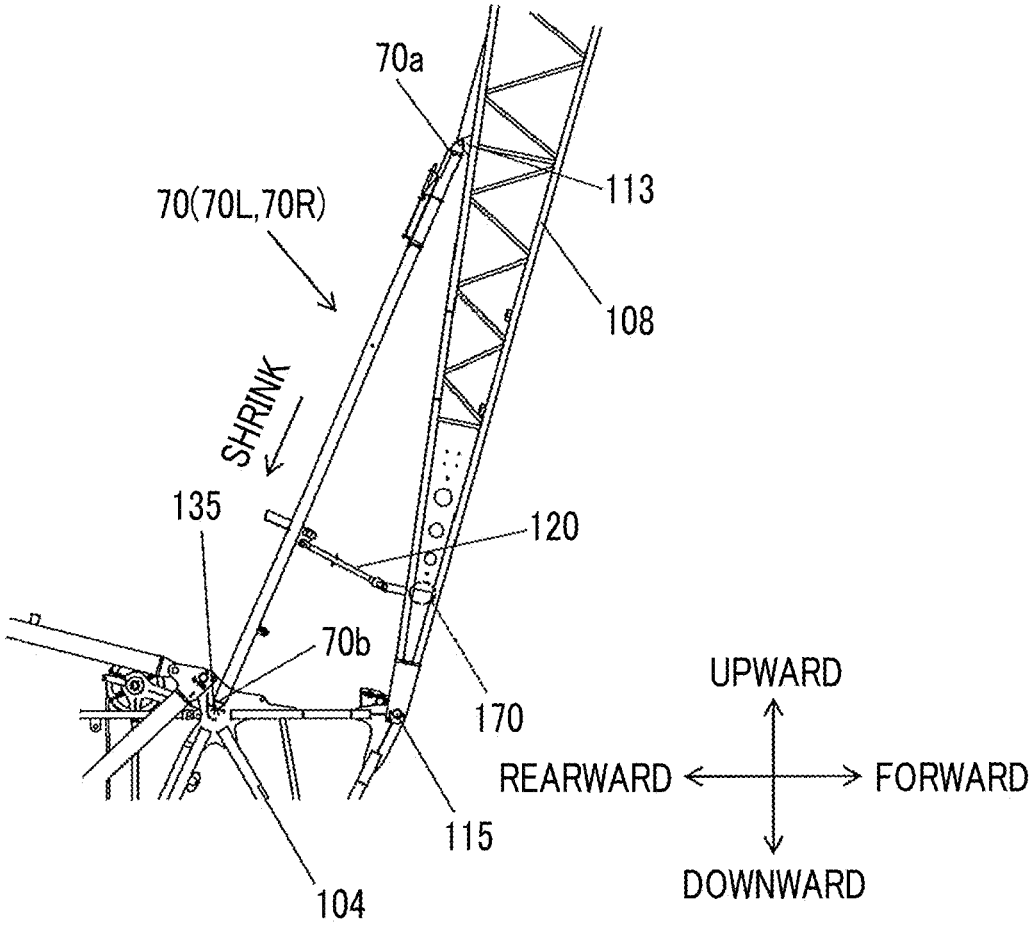
FIG. 5 is a side view of the jib backstop illustrating a state where a jib stands up to a maximum standing angle.

A rear surface side of the jib (front member) 108 has a pair of right and left jib backstops (backstop) 70. FIG. 3 is an enlarged view of a part A in FIG. 1, and is a side view of a jib backstop 70. FIG. 4 is a side view of the jib backstop 70 illustrating a state where the other end 70*b* of the jib backstop 70 is in contact with a target 135. FIG. 5 is a side view of the jib backstop 70 illustrating a state where the jib 108 stands up to the maximum standing angle.

The jib backstop 70 limits a pivot range of the jib 108 so that the jib 108 does not pivot at a maximum angle or more. One end 70*a* of the jib backstop 70 is pivotably attached to a support portion 113 of the jib 108. The other end 70*b* of the jib backstop 70 is a free end. A connection member 120 for connecting the jib backstop 70 and the jib 108 to each other is disposed at a position on the other end 70*b* side from the center of the jib backstop 70.

If the jib 108 pivots upward (rearward) around a connection pin 115 from a horizontal position and stands up at a predetermined angle (for example, 65°), the other end 70*b* of the jib backstop 70 is brought into contact with the target (contact portion) 135 as illustrated in FIG. 4. If the jib 108 further pivots rearward around the connection pin 115, the jib backstop 70 allows the jib 108 to pivot rearward while being displaced so that the jib backstop 70 itself shrinks. Then, as illustrated in FIG. 5, if the jib 108 finally stands up to the maximum standing angle (for example, 80°), the pivoting of the jib 108 is limited the jib 108 so that the jib 108 does not pivot further rearward (counterclockwise direction). In this way, the jib backstop 70 performs a stretching operation in an axial direction in accordance with the standing operation of the jib 108.

Figure 8A:
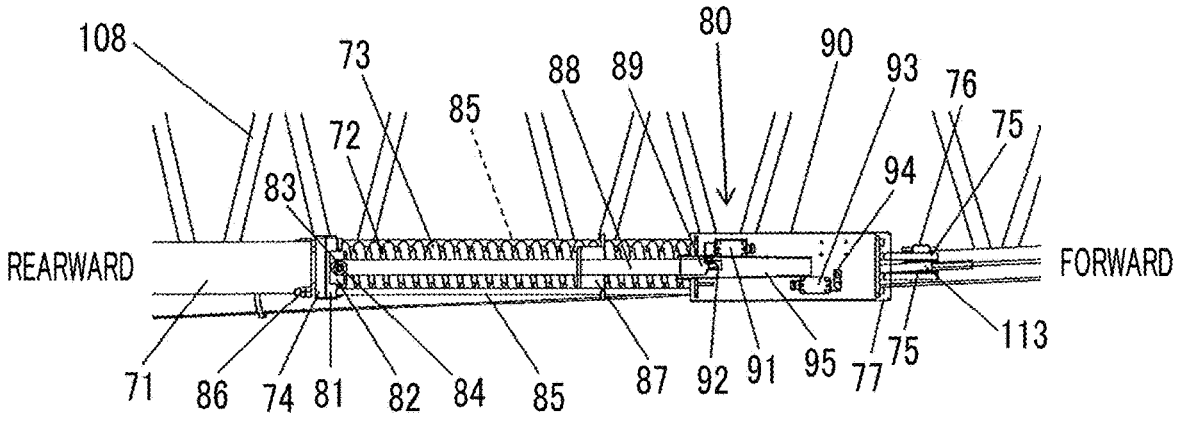
FIG. 8A is an enlarged plan view of a main part of the jib backstop.
Figure 8B:
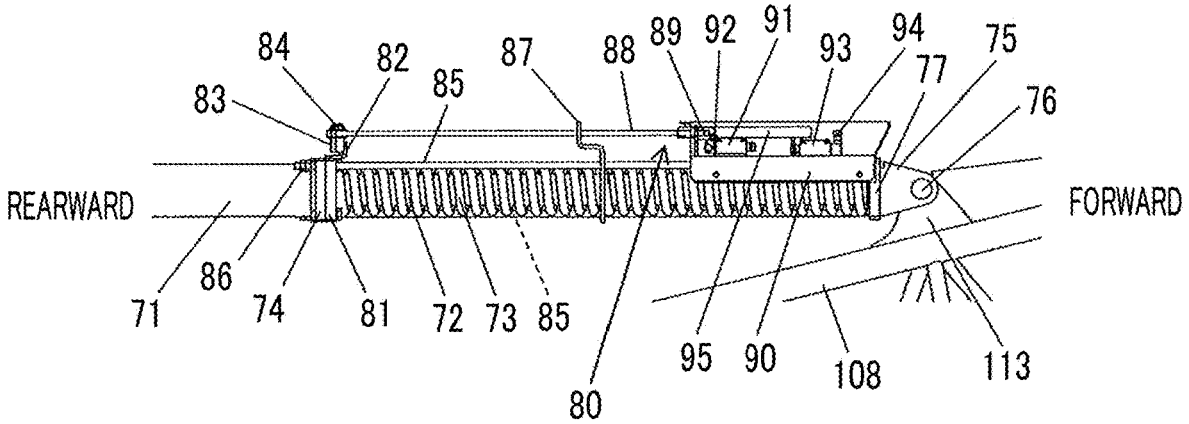
FIG. 8B is an enlarged side view of a main part of the jib backstop.
Figure 9A:
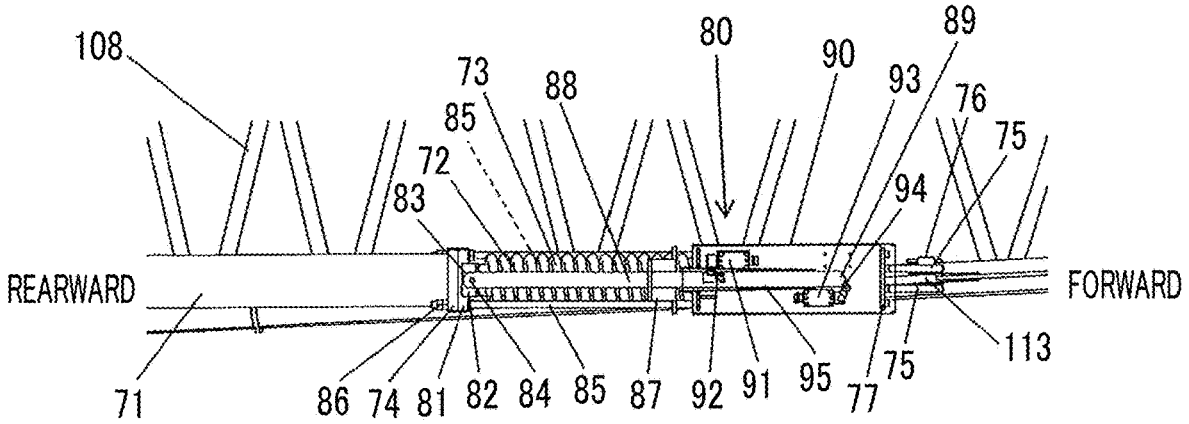
FIG. 9A is an enlarged plan view of a main part of the jib backstop.
Figure 9B:
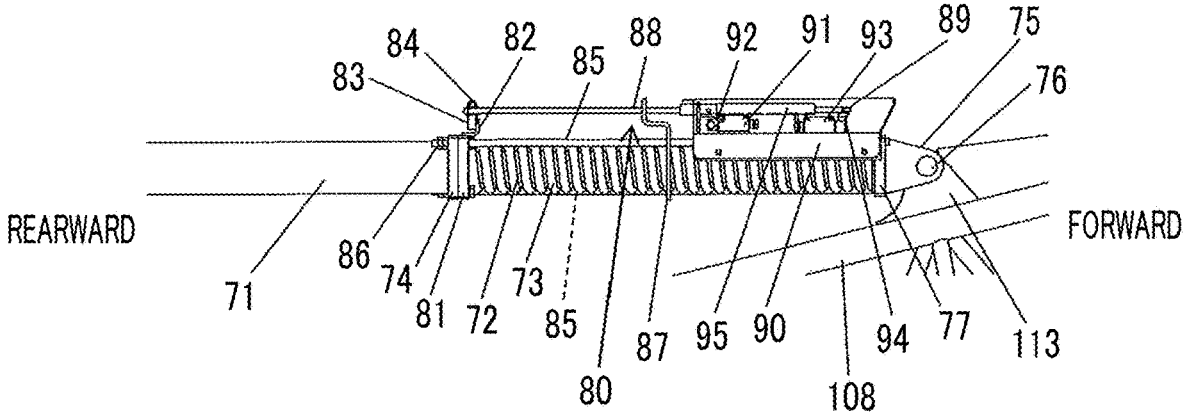
FIG. 9B is an enlarged side view of a main part of the jib backstop.

A structure of the jib backstop 70 will be described with reference to FIGS. 8A, 8B, 9A, and 9B in addition to FIGS. 3 to 5. FIG. 8A is an enlarged plan view of a main part of the jib backstop 70 when the jib 108 is in a state illustrated FIG. 4. FIG. 8B is an enlarged side view of a main part of the jib backstop 70 when the jib 108 is in the state illustrated FIG. 4. FIG. 9A is an enlarged plan view of a main part of the jib backstop 70 when the jib 108 is in a state illustrated in FIG. 5. FIG. 9B an enlarged side view of a main part of the jib backstop 70 when the jib 108 is in the state illustrated in FIG. 5.

As illustrated in FIGS. 8A, 8B, 9A, and 9B, the jib backstop 70 has an outer cylinder 71, an inner cylinder 72 slidably disposed inside the outer cylinder 71, and a compression spring 73. The distal end portion of the outer cylinder 71 configures the other end 70*b* of the jib backstop 70, and comes into contact with the target 135. A flange 74 having a rectangular shape is disposed in a proximal end portion of the outer cylinder 71. A connection plate 81 of a jib backstop operation detection device 80 (to be described later) is attached to the flange 74. Thee proximal end portion of the inner cylinder 72 has a holding member 77, and the holding member 77 has a pair of attachment members 75. A support portion 113 of the jib 108 is interposed between the pair of attachment members 75, and a pin 76 is inserted so that the inner cylinder 72 is pivotally supported by the support portion 113.

The compression spring 73 is inserted into an outer periphery of the inner cylinder 72, and is interposed between the connection plate 81 and the holding member 77. A biasing force of the compression spring 73 acts in a pressing direction of the connection plate 81. In this manner, the outer cylinder 71 is pressed against and held by a distal end side (left side in FIGS. 8A and 8B). If the jib 108 pivots rearward in a state where the distal end portion of the outer cylinder 71 is in contact with the target 135, the outer cylinder 71 is moved to the proximal end side (right side in FIGS. 8A and 8B) of the inner cylinder 72 against the biasing force of the compression spring 73. That is, the jib backstop 70 shrinks. In this way, the outer cylinder 71 is displaced as the jib 108 pivots, thereby causing jib backstop 70 to perform the stretching operation.

Jib Backstop Operation Detection Device

Figure 6:
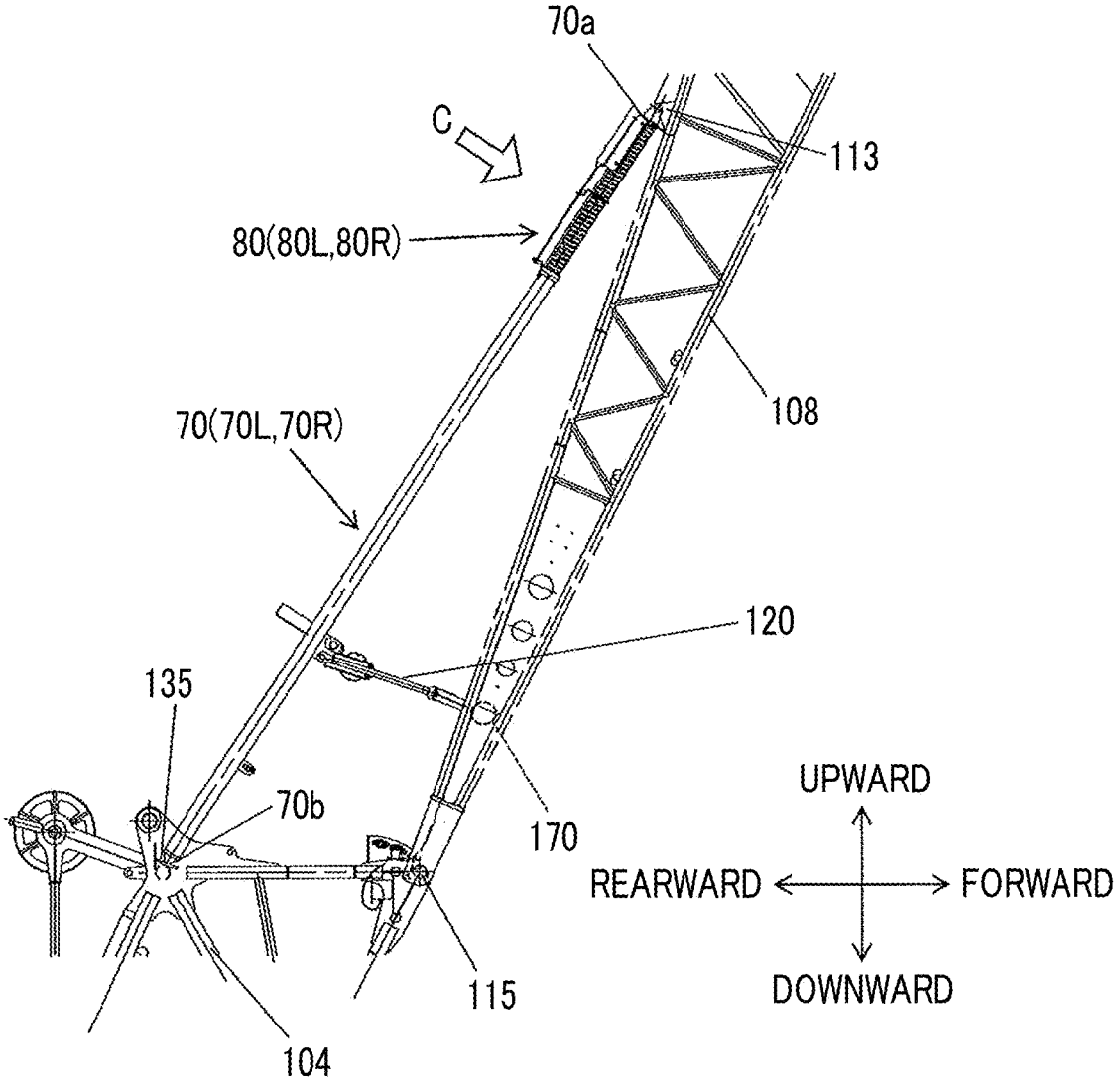
FIG. 6 is a side view of the jib backstop illustrating a part B in FIG. 4 in detail.

The jib backstop operation detection device (operation detection unit) 80 which detects an operation of the jib backstop 70 is disposed on a side of one end 70*a* of the jib backstop 70. The jib backstop operation detection device 80 will be described in detail with reference to FIGS. 6 and 7 in addition to FIGS. 8A, 8B, 9A, and 9B. FIG. 6 is a side view of the jib backstop 70 illustrating a part B in FIG. 4 in detail, and FIG. 7 is a view of the jib backstop 70 illustrated in FIG. 6, which is taken along an arrow C.

Figure 7:
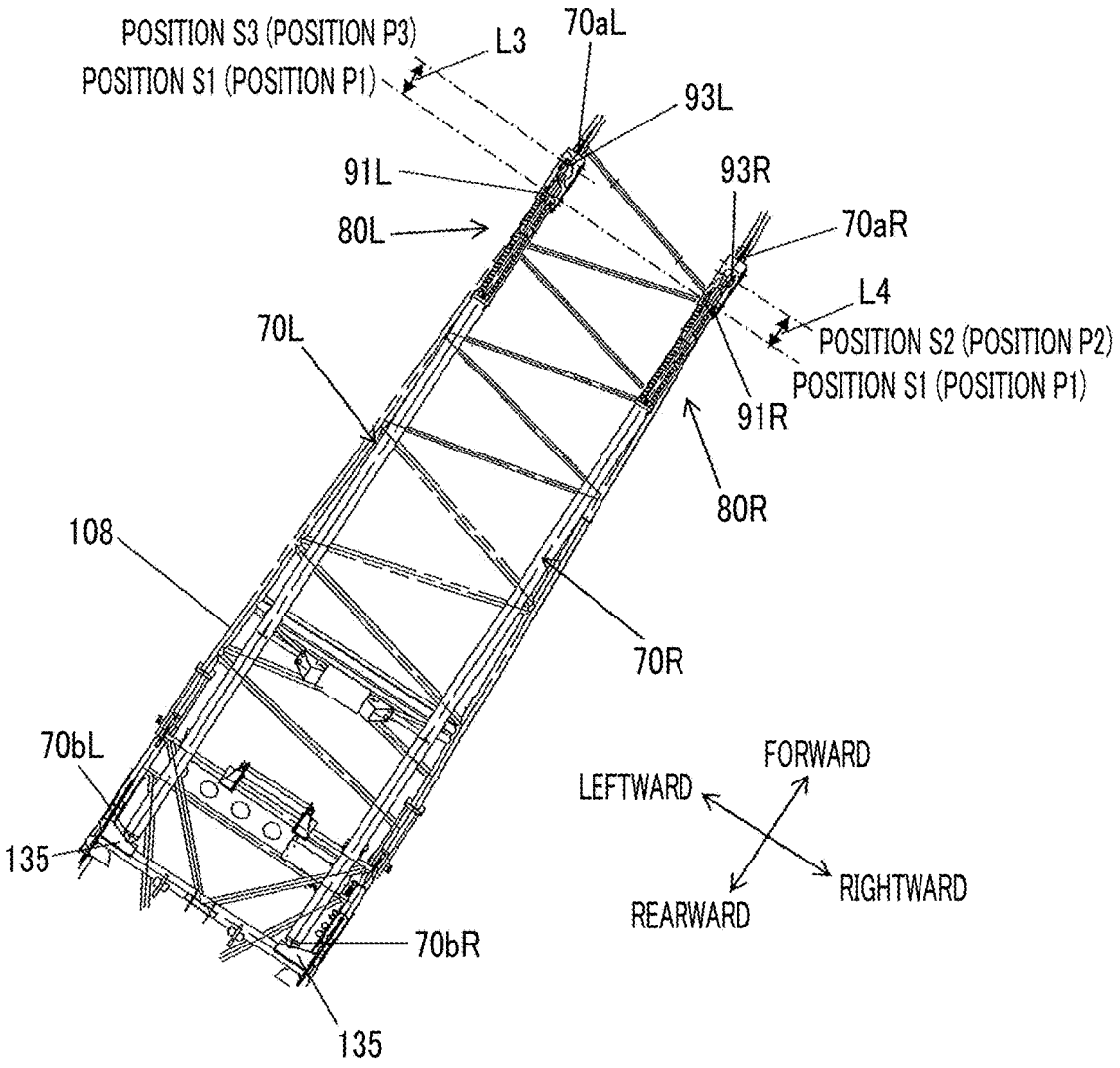
FIG. 7 is a view of the jib backstop illustrated in FIG. 6, which is taken along an arrow C.

As illustrated in FIGS. 6 and 7, the jib backstop operation detecting device (operation detection unit) 80 which detects the operation of the jib backstop 70 is disposed on the side of one end 70*a* of the jib backstop 70. As illustrated in FIGS. 8A and 8B, the jib backstop operation detection device 80 mainly includes the connection plate 81 connected to the flange 74 of the outer cylinder 71, a base plate 90 to which a jib backstop limit switch (first limit switch) 91 and a jib excessive winding limit switch 93 (second limit switch) 93 are attached, and an elongated slide bar (moving member) 88 laid between the connection plate 81 and the base plate 90.

The connection plate 81 has substantially the same outer shape as that of the flange 74, and is fixed to the flange 74 by using a bolt. An L-shaped bracket 82 is attached to an upper portion of the connection plate 81, and a columnar fixing portion 83 is attached to the bracket 82. A screw hole is disposed on an upper surface of the fixing portion 83, and one end of the slide bar 88 is fixed thereto by using a bolt 84. In this manner, the slide bar 88 slides in conjunction with the movement of the outer cylinder 71 in the axial direction (forward-rearward direction of the jib 108, rightward-leftward direction in FIGS. 8A and 8B).

The base plate 90 is fixed to a base fixing portion (not illustrated) attached to the holding member 77 of the inner cylinder 72, and is held in a horizontal state. The base plate 90 has a guide 95 for slidably supporting the other end of the slide bar 88. The guide 95 guides the movement of the slide bar 88 in a longitudinal direction (axial direction of the jib backstop 70). A pair of right and left round bars 85 is disposed so as to penetrate the flange 74, the connection plate 81, and the holding member 77, and each of the round bars 85 is fixed by using a nut 86. A crank-shaped intermediate support 87 is fixed to a substantially center position of the round bars 85. A penetrating hole through which the slide bar 88 penetrates is disposed in an upper portion of the intermediate support 87, and the slide bar 88 is slidably supported by the intermediate support 87.

A striker 89 is disposed in the other end of the slide bar 88. If the slide bar 88 slides, in accordance with a slide position, the striker 89 presses down a roller 92 of a jib backstop limit switch 91 (hereinafter, abbreviated as a limit switch 91) and/or a roller 94 of a jib excessive winding limit switch 93 (hereinafter, abbreviated as a limit switch 93) rollers 94, thereby turning on a contact. If the respective limit switches 91 and 93 are operated, an ON-signal (operation signal) is output to the controller 200A. In the present embodiment, the limit switches 91 and 93 are roller lever type. However, the other types of the limit switch, for example, a V-lever type may be used.

As illustrated in FIG. 7, a jib backstop operation detection device 80L on the left side and a jib backstop operation detection device 80R on the right side are arranged in parallel with each other in the rightward-leftward direction of the jib 108, and are arranged at the same position in the forward-rearward direction of the jib 108. A limit switch 91L and a limit switch 91R are arranged at the same position S1 in the forward-rearward direction of the jib 108. Therefore, the limit switches 91L and 91R are operated at the same timing. On the other hand, a limit switch 93L is located at a position S3 forward of the limit switch 91L as much as a distance L3 (corresponding to a displacement difference L3 in FIG. 10B), and a limit switch 93R is located at a position S2 forward of the limit switch 91R as much as a distance L4 (corresponding to a displacement amount L4 in FIG. 10B) (L3>L4). That is, the limit switch 93L is located slightly forward of the limit switch 93R. Therefore, the limit switch 93R is operated earlier than the limit switch 93L. As a matter of course, a positional relationship between the limit switch 93L and the limit switch 93R may be reversed.

Figure 10A:
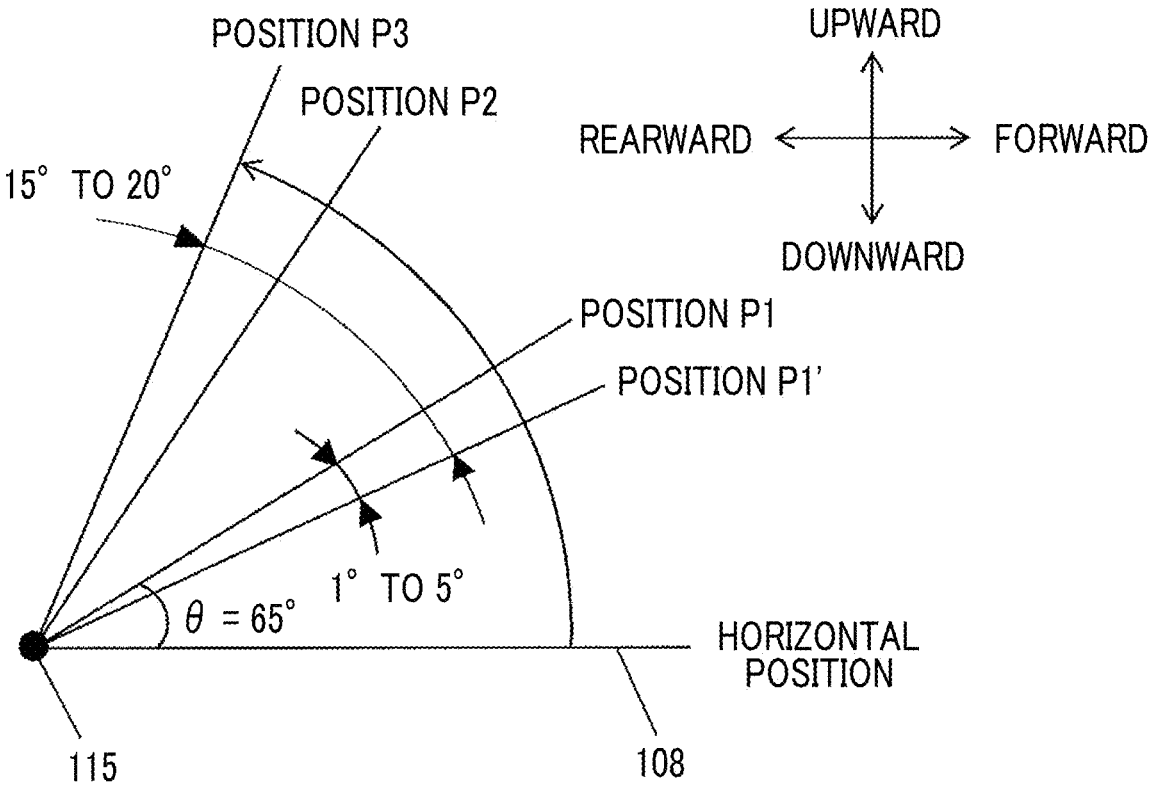
FIG. 10A is a schematic view illustrating a positional relationship between a pivot position of a jib and limit switches.
Figure 10B:
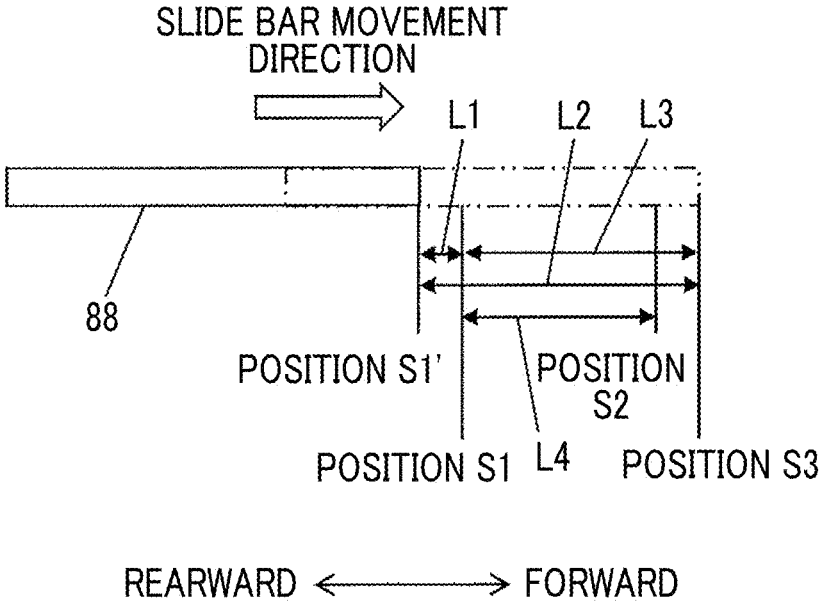
FIG. 10B is a schematic view illustrating a positional relationship between a slide position of a slide bar and the limit switches.

A relationship between a position of the limit switches 91 and 93 and a pivot position of the jib 108 will be described in detail with reference to FIGS. 10A and 10B. FIG. 10A is a schematic view illustrating a positional relationship between the pivot position of the jib 108 and the limit switches 91 and 93. FIG. 10B is a schematic view illustrating a positional relationship between a slide position of the slide bar 88 and the limit switches 91 and 93. As illustrated in FIG. 10A, if the jib 108 starts the standing operation from a horizontal position and the jib 108 pivots to a position P1', the jib backstop 70 starts to come into contact with the target 135. That is, the position P' is a "contact position" where the jib 108 or the backstop 70 starts to come into contact with the target 135. In this case, as illustrated in FIG. 10B, in conjunction with the standing operation of the jib 108, the slide bar 88 also slides in a forward direction, and is displaced to a position S' corresponding to the position P'.

If the jib 108 pivots from the position P1' to the position P1 where the jib 108 pivots in a counterclockwise direction (rearward) around the connection pin 115 as much as a first pivot angle (1° to 5°), the jib backstop 70 shrinks as much as a displacement amount L1 (first displacement amount) corresponding to a first pivot angle. Accordingly, the slide bar 88 is displaced to a position S1 (first position) corresponding to the position P1. If the slide bar 88 moves to the position S1, the striker 89 presses down the roller 92 of the limit switch 91, thereby turning on the limit switch 91 (states illustrated in FIGS. 8A and 8B). The limit switches 91L and 91R are disposed at the same position S1. Accordingly, the limit switches 91L and 91R are turned on at the same time.

Here, in the present embodiment, a reason that the first pivot angle is set in a range of 1° to 5° is as follows. Due to variations in manufacturing the jib backstops 70L and 70R or an error of an attachment position of the limit switches 91L and 91R, there is a possibility that of variations in a position (contact position) where the jib backstops 70L and 70R respectively start to come into contact with targets 135L and 135R. That is, according to the present embodiment, in order to reliably detect that the jib backstop 70 is in contact with the target 135, the limit switch 91 is operated at the position P1 where the jib 108 stands up at approximately 1° to 5° from the position P1' where the jib backstop 70 starts to come into contact with the target 135. In this manner, in a case where the limit switch 91 is operated, it can be determined that the jib backstop 70 is reliably in contact with the target 135.

In a state where the jib backstop 70R is in contact with the target 135R, if the jib 108 pivots from the position P1 to the position P2, the jib backstop 70R shrinks as much as a displacement amount L4, and the slide bar 88R moves to a position S2 corresponding to the position P2. If the slide bar 88R moves to the position S2, the striker 89R presses down the roller 94R of the limit switch 93R, thereby turning on the limit switch 93R. In this case, the limit switch 93L is disposed at a position S3. Accordingly, the limit switch 93L is not operated. Although details will be described later, if the limit switch 93R is operated, the standing operation of the jib 108 is stopped. The winding operation of the hook 110 is not stopped in a state where the jib 108 is located the position P2.

If the jib 108 reaches a position P3 where the jib 108 pivots (stands up) as much as a second pivot angle (15° to 20°) in the counterclockwise direction around the connection pin 115 from the position P1, the jib backstop 70L shrinks as much as a displacement amount L2 (second displacement amount) corresponding to a second pivot angle. Accordingly, the slide bar 88L moves to a position S3 (second position) corresponding to the position P3. If the slide bar 88L moves to the position S3, the striker 89L presses down the roller 94L of the limit switch 93L, thereby turning on the limit switch 93L (states in FIGS. 9A and 9B). If the limit switch 93L is operated, in addition to the stop of the standing operation of the jib 108, the winding operation of the hook 110 is also stopped.

Controller

Figure 11:
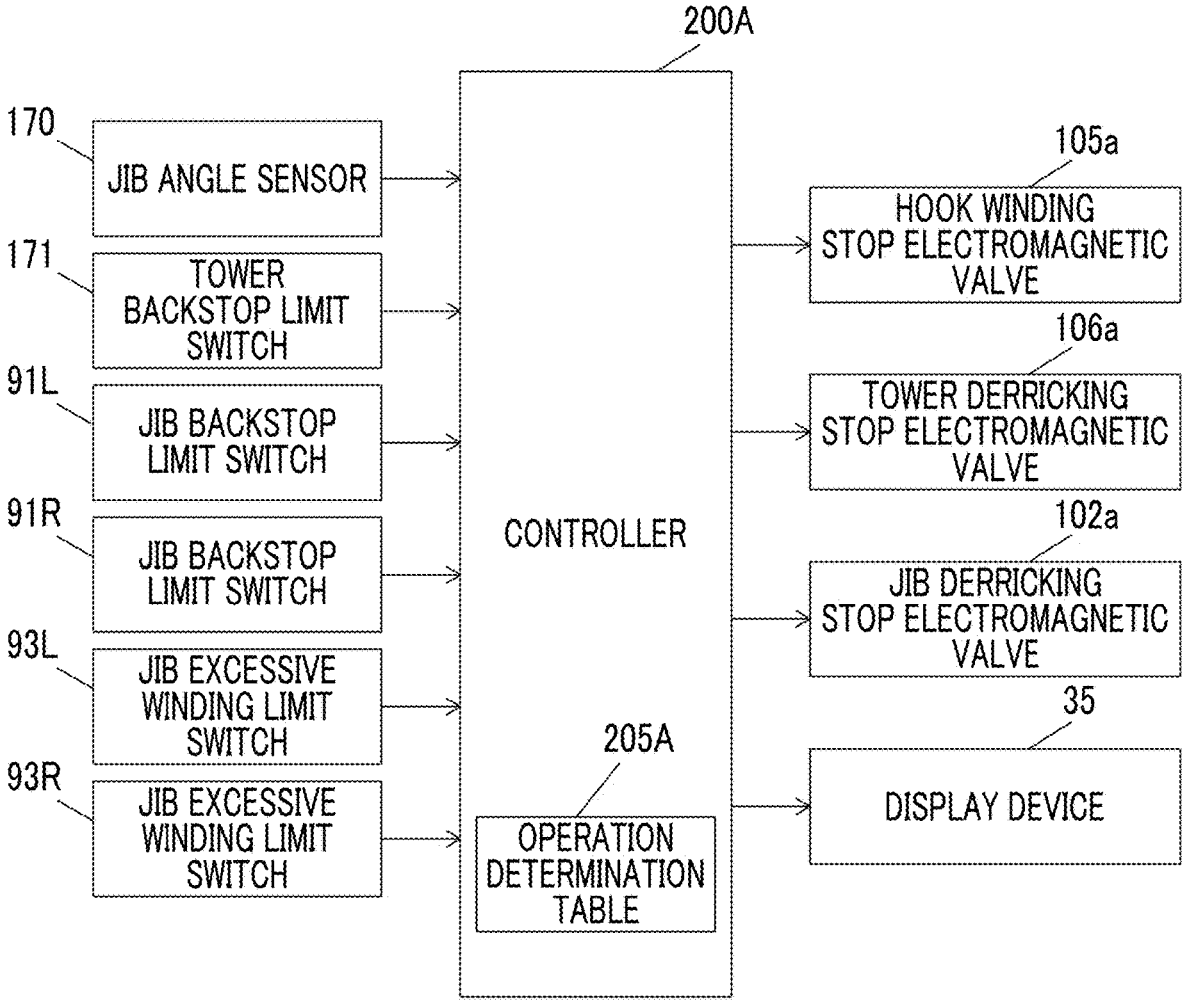
FIG. 11 is a block diagram illustrating an input to and an output from a controller.

Next, a configuration of the controller 200A mounted on the crane 100A will be described. FIG. 11 is a block diagram illustrating an input to and an output from to the controller 200A. The controller 200A is a control device for controlling each part of the crane 100A. Although not illustrated, the controller 200A includes a CPU for performing various calculations, a memory serving as a storage device, a communication interface, and other peripheral devices.

Each detection signal is input to the controller 200A from the jib angle sensor 170 for detecting an angle of the jib 108, the limit switch 171 for detecting an operation of the tower backstop 50, the limit switches 91L, 91R, 93L, and 93R for detecting an operation of the jib backstop 70, and other sensors (not illustrated). The controller 200A performs a predetermined computation process, based on each input detection signal, and outputs a control signal to the hook winding stop electromagnetic valve 105*a*, the tower derricking stop electromagnetic valve 106*a*, the jib derricking stop electromagnetic valve 102*a*, the display device 35, and other devices (not illustrated).

Controlling of Jib Derricking Operation

Figure 12:
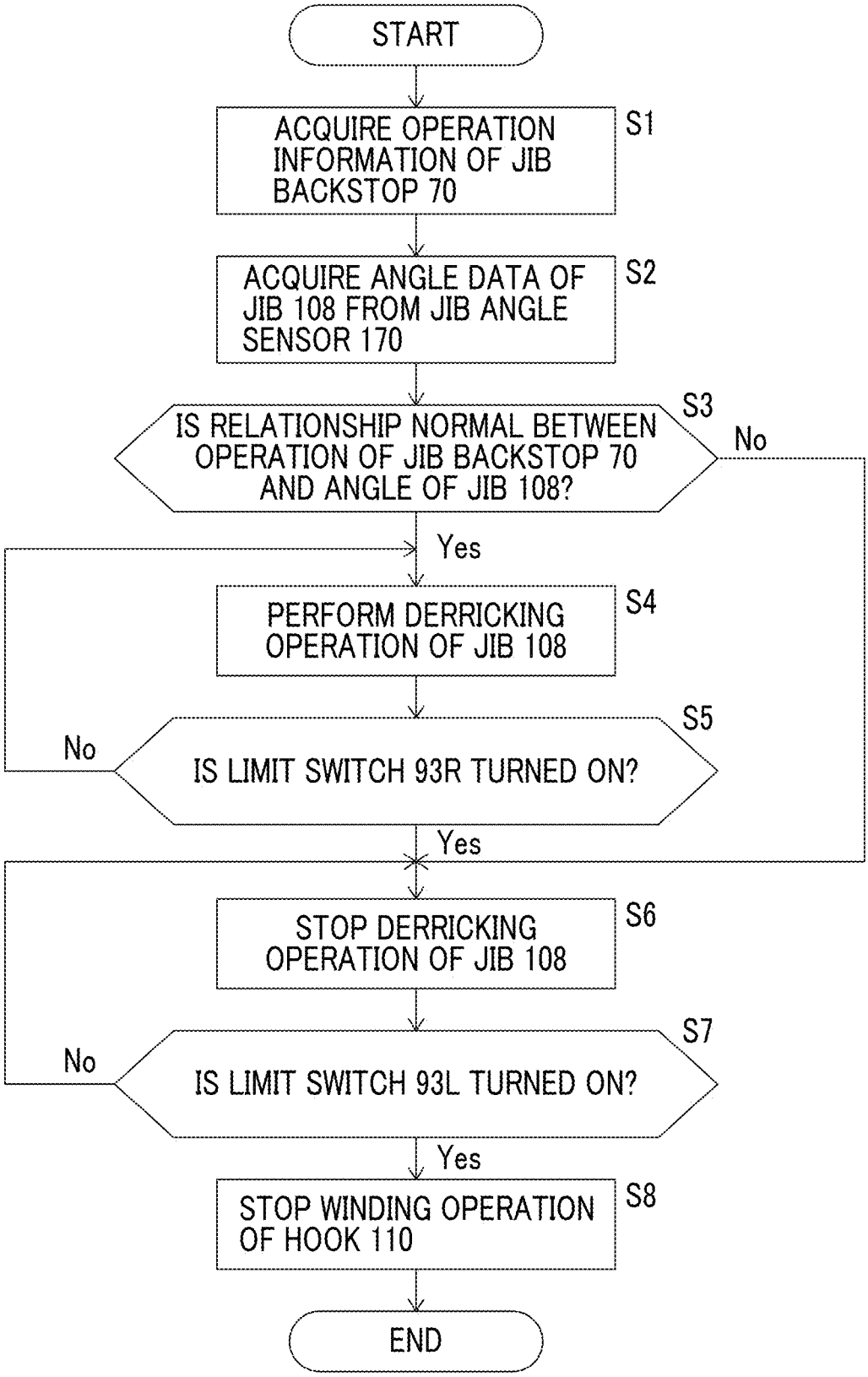
FIG. 12 is a flowchart illustrating a control procedure of a derricking operation of the jib which is performed by the controller.

Next, controlling of the derricking operation of the jib 108 controlled by the controller 200A will be described. FIG. 12 is a flowchart illustrating a control procedure of the derricking operation of the jib 108 controlled by the controller 200A. As illustrated in FIG. 12, if the derricking operation of the jib 108 starts, the controller 200A acquires operation information of the jib backstop 70, based on an operation signal output from the limit switch 91 (Step S1). Based on a detection signal output from the jib angle sensor 170, the controller 200A acquires angle data of the jib 108 (Step S2). Next, the controller 200A determines whether or not a relationship between the operation of the jib backstop 70 and an angle of the jib 108 is normal (Step S3). An operation determination table 205A for determining whether or not the operation of the jib backstop 70 is normal is stored in a memory of the controller 200A.

FIG. 13 is a view illustrating the operation determination table 205A which stipulates whether or not the operation of the jib backstop 70 is normal. The operation determination table 205A illustrated in FIG. 13 stipulates whether or not the operation of the jib backstop 70 is normal, based on an angle (jib angle) θ and the limit switches 91L and 91R. Specifically, in a case where the angle (the jib angle) θ of the jib 108 is smaller than 65°, and in a case where both the limit switches 91L and 91R are turned off, it is stipulated that the operation of the jib backstop 70 is "normal". In a case where the jib angle θ is 65 degrees or larger, it is stipulated that the operation of the jib backstop 70 is defined as "normal" only in a case where both the limit switches 91L and 91R are turned on. In a case where at least one of the limit switches 91L and 91R are turned off, it is stipulated that the operation of the jib backstop 70 is "abnormal".

Here, the jib angle θ=65° means a state where the jib 108 is located at the position P1 (refer to FIG. 10A). If the operation is normal, the other end 70*b* of the jib backstop 70 is reliably in contact with the target 135, and both the limit switches 91L and 91R are supposed to output the ON-signal. Therefore, according to the present embodiment, in a case where the jib angle θ is 65° or larger, and in a case where at least one of the limit switches 91L and 91R is turned off, it is determined that the jib backstop 70 is not in contact with the target 135 due to a failure (the slide bar 88 is not moved to the position S1), and it is stipulated that the operation of the jib backstop 70 is abnormal.

In a case where the controller 200A determines that the operation in Step S3 is normal (S3/Yes), the controller 200A performs the derricking operation of the jib 108 (Step S4). In a case where the jib 108 performs the standing operation up to the position P2 and the limit switch 93R is operated (Step S5/Yes), the controller 200A operates the jib derricking stop electromagnetic valve 102*a* (refer to FIG. 11), and stops the derricking operation of the jib 108 (Step S6). In a case where the controller 200A determines that the operation in Step S3 is abnormal (S3/No), the controller 200A proceeds to Step S6, and stops the derricking operation of the jib 108. In this manner, the jib 108 is prevented from performing the standing operation in a state where the jib backstop 70 is not in contact with the target 135. In a case where it is determined that the operation in Step S3 is abnormal, the controller 200A outputs an abnormality signal to the display device 35, and notifies the display device 35 of a fact that the jib backstop 70 is not in contact with the target 135.

In a case where the jib 108 performs the derricking operation up to the position P3 and the limit switch 93L is turned on (S7/Yes), the controller 200A operates the hook winding stop electromagnetic valve 105*a* (refer to FIG. 11), and stops the winding operation of the hook 110 (Step S8) so as to complete the process.

As described above, according to the first embodiment, the controller 200A determines that the angle θ of the jib 108 is 65° or larger. In a case where it is determined that the other end 70*b* of the backstop 70 is not in contact with the target 135, based on a detection signal of the limit switches 91L and 91R, the controller 200A is configured to stop the standing operation of the jib 108. Accordingly, when the jib backstop 70 malfunctions, the crane 100A can be safely operated. The malfunction of the jib backstop 70 can be detected by the limit switch 91 which is turned on or off. Therefore, the jib backstop operation detection device 80 can adopt an inexpensive and simple configuration.

Here, in some cases, the limit switch 93 is disposed in the crane in the related art in order to prevent the jib from being excessively wound. In this case, the limit switch 93 is located at a position between the position S1 and the position S3. If the design is changed so that the limit switch 93 is turned on when the jib 108 pivots to a position between the position P1 and the position P3, whether or not the jib backstop 70 is in contact with the target 135 can be detected without increasing the number the limit switches. However, if the limit switch 93 is moved to the position between the position S1 and the position S3, the jib 108 stops the standing operation at the position between the position P1 and the position P3. Accordingly, a pivot range of the jib 108 is narrowed compared to that in the related art. Therefore, this configuration is not preferable since original lifting work of the crane is adversely affected.

On the other hand, according to the first embodiment, the limit switch 91 is additionally located at the position S1 in order to detect the malfunction of the jib backstop 70. In this manner, an exceptional operation effect is achieved in that safety can be improved without impairing workability of the crane 100A. Even if the jib angle θ is 65° or larger, in a case where at least one of the limit switches 91L and 91R is turned off, it is determined that the jib backstop 70 is not in contact with the target 135 (abnormal), and the standing operation of the jib 108 is stopped. Therefore, the crane 100A can be more safely operated.

Second Embodiment

Figure 14A:
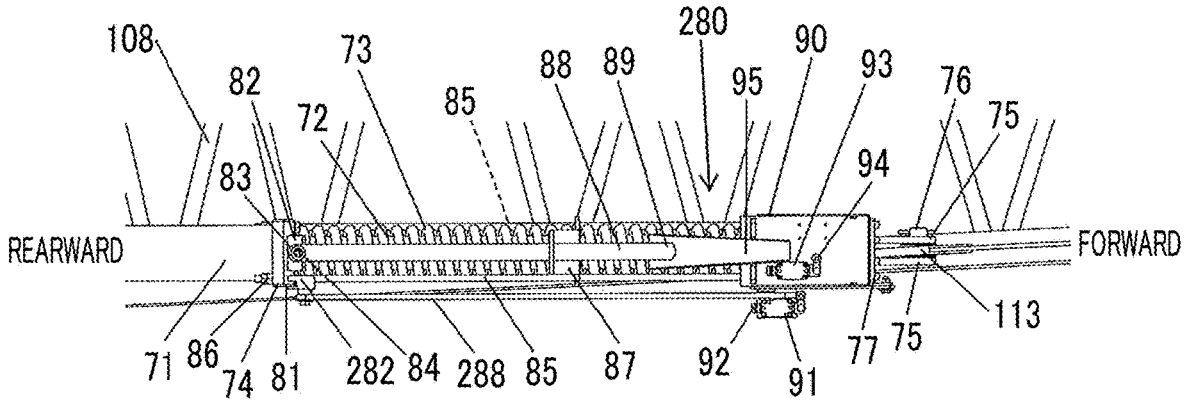
FIG. 14A is a plan view illustrating a configuration of a jib backstop operation detection device according to a second embodiment.

In a crane 100B according to a second embodiment, a configuration of a jib backstop operation detection device is partially different from that according to the first embodiment. Hereinafter, points different from those according to the first embodiment will be mainly described. FIG. 14A is a plan view illustrating a configuration of a jib backstop operation detection device 280 according to the second embodiment, and FIG. 14B is a side view illustrating the configuration of the jib backstop operation detection device 280 according to the second embodiment.

Figure 14B:
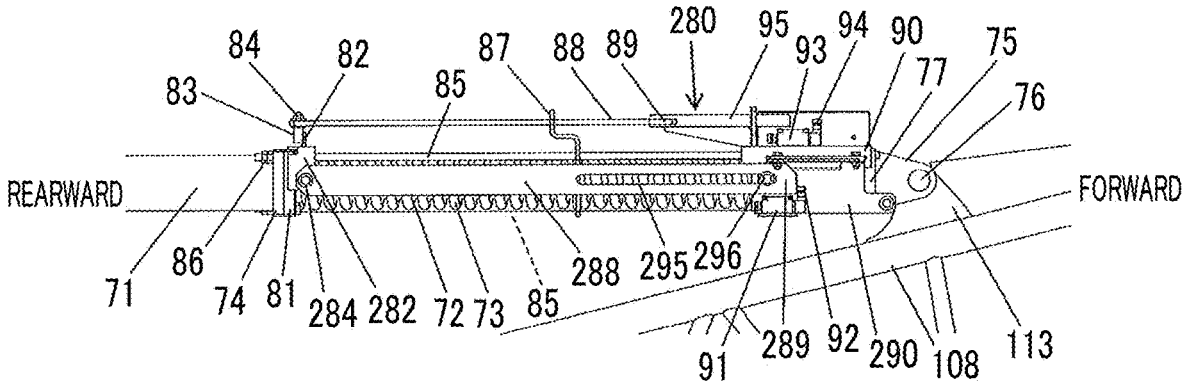
FIG. 14B is a side view illustrating the configuration of the jib backstop operation detection device according to the second embodiment.

As illustrated in FIGS. 14A and 14B, according to the second embodiment, moving members for operating the limit switch 91 and the limit switch 93 are configured to be respectively separate members. Specifically, whereas a slide bar 88 serving as a second moving member operates only the limit switch 93, a side bar 288 serving as first moving member operates only the limit switch 91. According to the first embodiment, the slide bar 88 and the side bar 288 are integrated with each other so as to configure one moving member.

The side bar 288 is formed of an elongated plate-shaped body. One end thereof is fixed to a bracket 282 attached to a side portion of the connection plate 81 by using a bolt 284 and the other end is slidably supported by a guide pin 296. The guide pin 296 engages with an elongated hole 295 disposed in the side bar 288, and guides the side bar 288 to move in the forward-rearward direction. The guide pin 296 is fixed to a side bracket 290 fixed to the base plate 90.

According to this configuration, the other end 70*b* of the jib backstop 70 comes into contact with the target 135. In conjunction with the movement of the outer cylinder 71 in the forward-rearward direction, the side bar 288 is also moved in the forward-rearward direction. Then, if the jib 108 pivots to the position P1 (refer to FIG. 10A), a striker 289 disposed in the other end of the side bar 288 pressed down the roller 92 of the limit switch 91, thereby turning on the contact of the limit switch 91.

In this way, the second embodiment can also achieve the same operation effect as that according to the first embodiment. In particular, according to the second embodiment, the side bar 288 and the limit switch 91 can be externally attached to the existing crane. Therefore, there is an advantage in that the existing crane can be safely operated through simple remodeling.

Third Embodiment

Figure 15A:
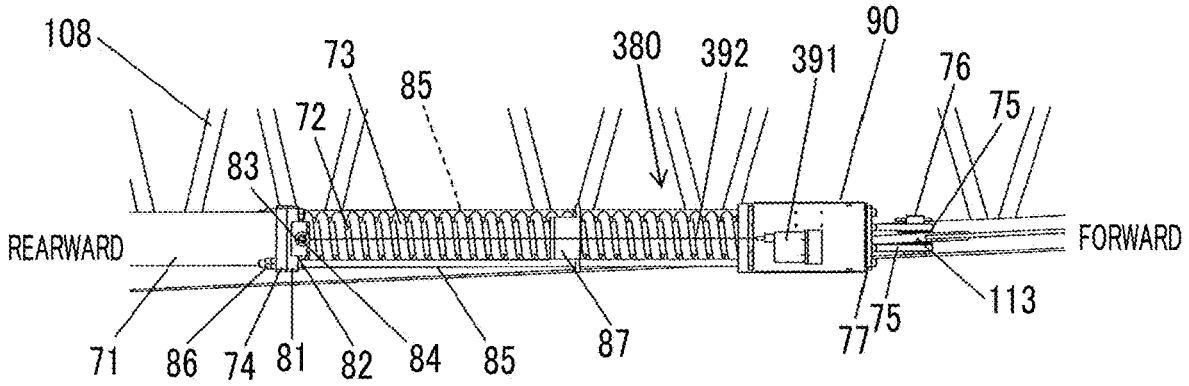
FIG. 15A is a plan view illustrating a configuration of a jib backstop operation detection device according to a third embodiment.

A configuration of a crane 100C according to a third embodiment is different from the configuration according to the first and second embodiments in that a wire-type displacement meter 391 is used instead of the limit switch 91 in order to detect the operation of the jib backstop 70. That is, a jib backstop operation detection device 380 according to the third embodiment includes the wire-type displacement meter 391. Hereinafter, points different from those according to the first and second embodiments will be mainly described. FIG. 15A is a plan view illustrating a configuration of the jib backstop operation detection device 380 according to the third embodiment, and FIG. 15B is a side view illustrating the configuration of the jib backstop operation detection device 380 according to the third embodiment.

Figure 15B:
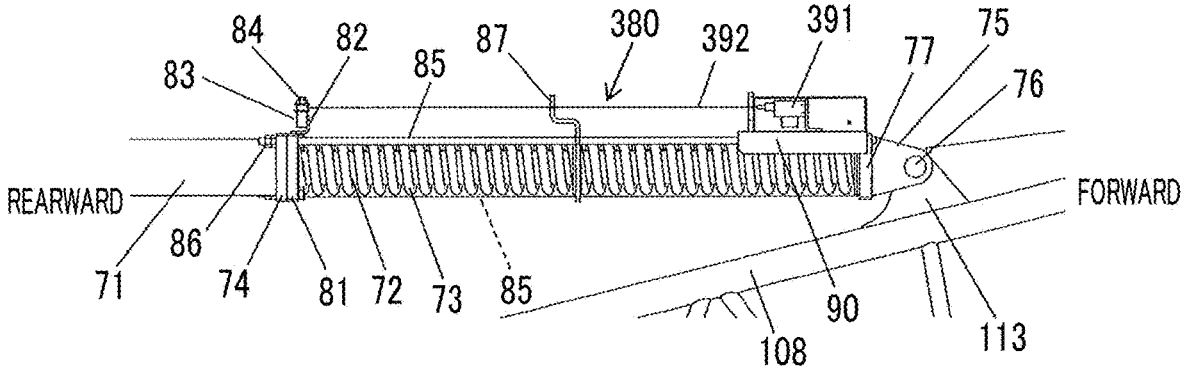
FIG. 15B is a side view illustrating the configuration of the jib backstop operation detection device according to the third embodiment.

As illustrated in FIGS. 15A and 15B, the wire-type displacement meter 391 (hereinafter, abbreviated as the displacement meter 391) for detecting a displacement amount generated by the stretching operation of the jib backstop 70 is disposed in the base plate 90. A distal end portion of a wire 392 of the displacement meter 391 is fixed to a fixing portion 83. If the outer cylinder 71 moves in the forward-rearward direction, the wire 392 is pulled out or wound up. The displacement amount of the wire 392 is detected by a potentiometer incorporated in the displacement meter 391. In this manner, the operation of the jib backstop 70 can be detected. A detection signal of the displacement meter 391 is input to a controller 200C. Based on the detection signal of the displacement meter 391 and the detection signal of the jib angle sensor 170, the controller 200C performs permission control of the derricking operation of the jib 108.

Figure 16:
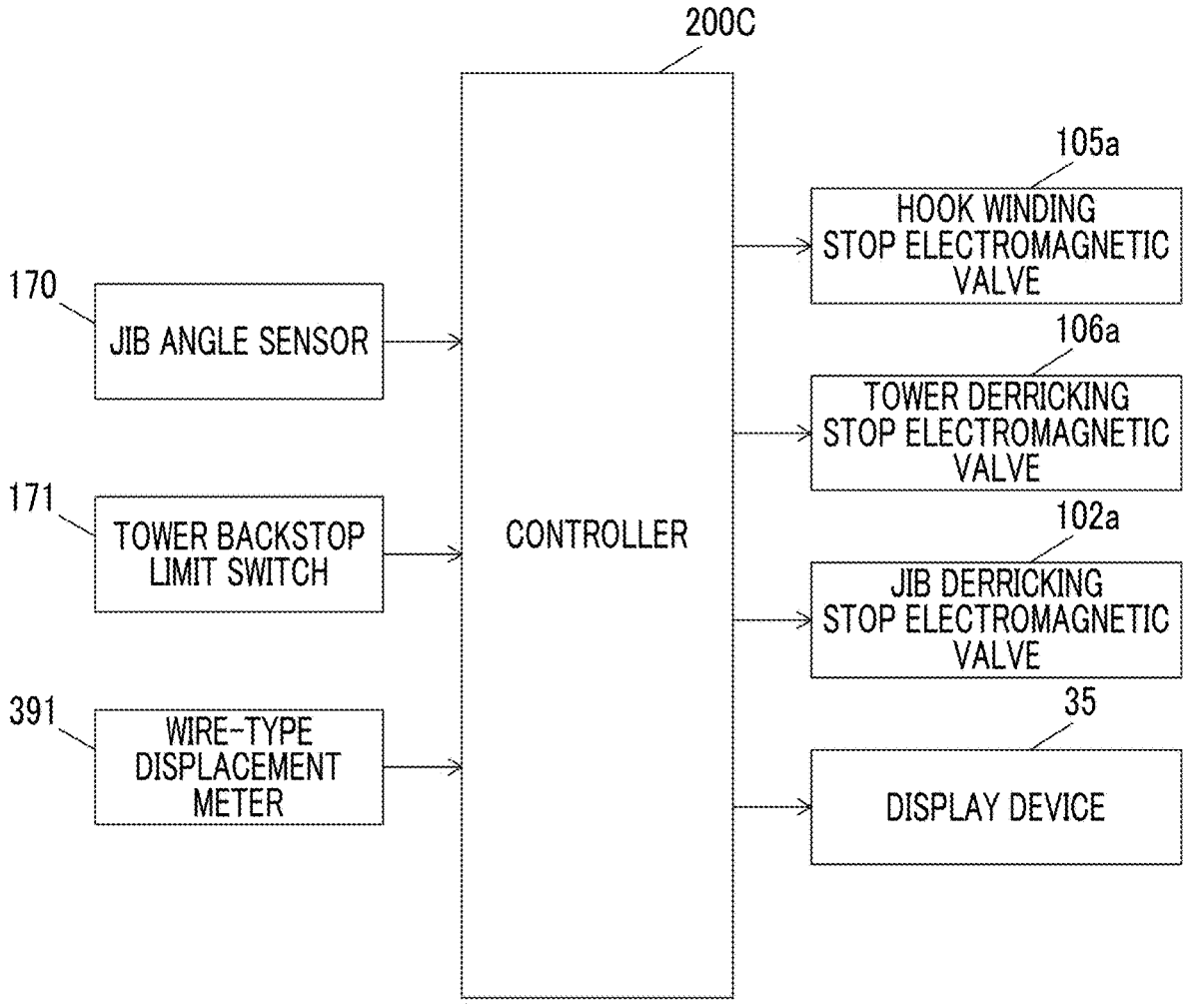
FIG. 16 is a block diagram illustrating an input to and an output from a controller.

FIG. 16 is a block diagram illustrating an input to and an output from the controller 200C. The controller 200C according to the third embodiment is a control device for controlling each part of the crane 100C. Although not illustrated, the controller 200C includes a CPU for performing various calculations, a memory serving as a storage device, a communication interface, and other peripheral devices.

As illustrated in FIG. 16, each detection signal is input to the controller 200C from the jib angle sensor 170 for detecting an angle of the jib 108, the limit switch 171 for detecting an operation of the tower backstop 50, the displacement meter 391 for detecting an operation of the jib backstop 70, and other sensors (not illustrated). The output side of the controller 200C is the same as that according to the first embodiment.

Figure 17:
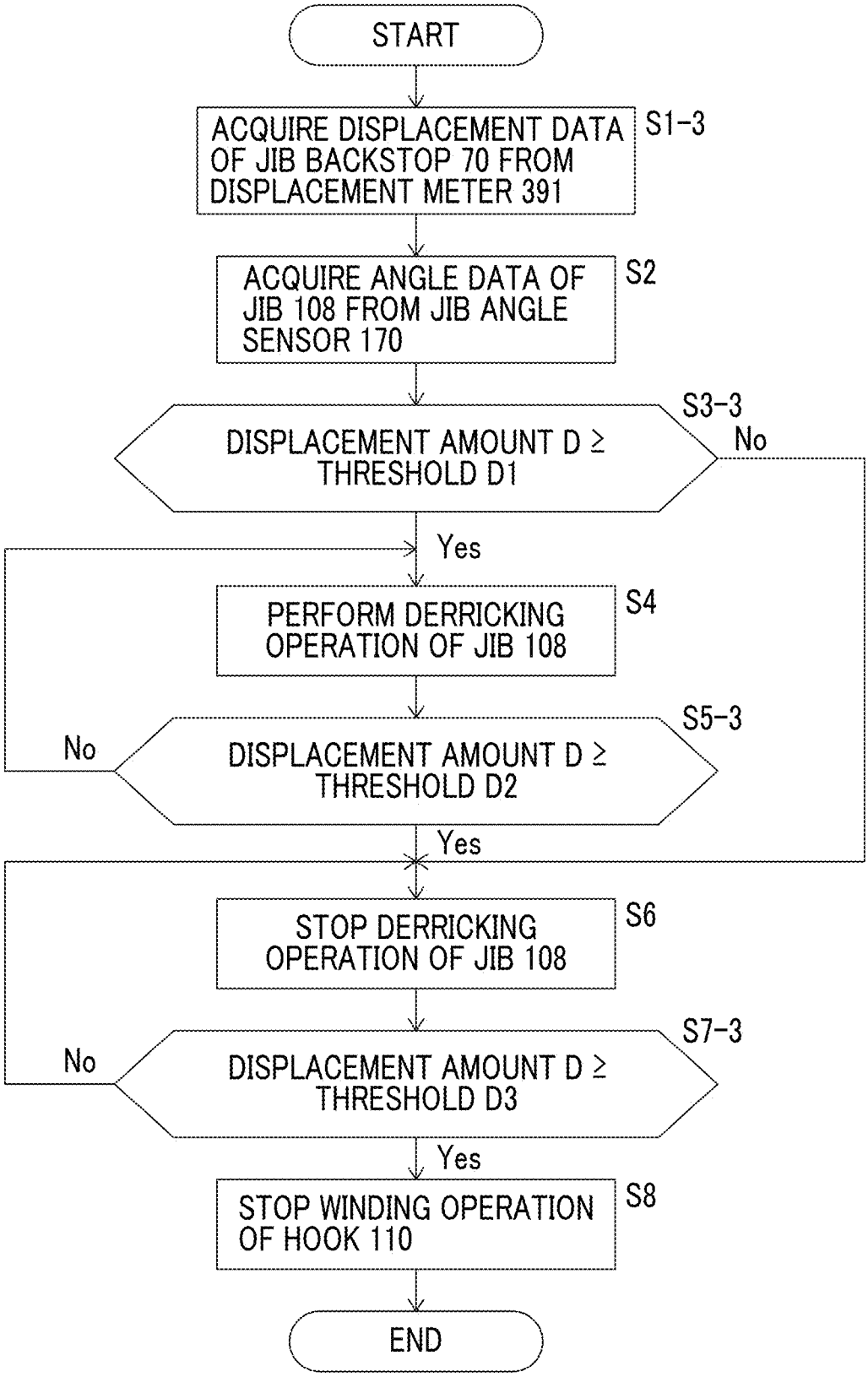
FIG. 17 is a flowchart illustrating a control procedure of a derricking operation of the jib which is performed by the controller.

FIG. 17 is a flowchart illustrating a control procedure of the derricking operation of the jib 108 according to the third embodiment. As illustrated in FIG. 17, the controller 200C acquires displacement data of the jib backstop 70 from the displacement meter 391 (Step S1-3), and acquires angle data of the jib 108, based on the detection signal from the jib angle sensor 170 (Step S2). Next, the controller 200C determines whether or not a displacement amount D of the jib backstop 70 is a threshold D1 or greater (Step S3-3). In a case where the displacement amount D is the threshold D1 or greater (Step S3-3/Yes), the controller 200C performs the derricking operation of the jib 108 (Step S4). Here, the threshold D1 is used in order to determine whether or not the other end 70*b* of the jib backstop 70 is reliably in contact with the target 135. For example, the threshold D1 is set in advance to a displacement amount L1 (refer to FIG. 10B).

Next, if the controller 200C determines that the displacement amount D is a threshold D2 or greater (Step S5-3/Yes), the controller 200C operates the jib derricking stop electromagnetic valve 102*a*, and stops the derricking operation of the jib 108 (Step S6). Here, for example, the threshold D2 is set in advance to a displacement amount L1+L4 (refer to FIG. 10B).

In a case where the controller 200C determines that the displacement amount D is smaller than the threshold D1 (S3-3/No) in the determination process in Step S3-3, the controller 200C proceeds to Step S6 so as to stop the derricking operation of the jib 108, and notifies the display device 35 of a fact that the operation is abnormal. In this manner, the jib 108 is prevented from performing the standing operation in a state where the jib backstop 70 is not in contact with the target 135.

In a case where the controller 200C determines that the displacement amount D is a threshold D3 or greater (S7-3/Yes), the controller 200C operates the hook winding stop electromagnetic valve 105*a* so as to stop the winding operation of the hook 110 (Step S8), and completes the process. Here, for example, the threshold D3 is set in advance to a displacement amount L2 (refer to FIG. 10B).

In this way, similarly to the first and second embodiments, according to the third embodiment, even if the jib backstop 70 malfunctions, the crane 100C can also be safely operated. Moreover, the displacement meter 391 is used instead of the limit switches 91 and 93. Accordingly, the configuration of the jib backstop operation detection device 380 can be simplified, and can be inexpensively manufactured.

Fourth Embodiment

Figure 18:
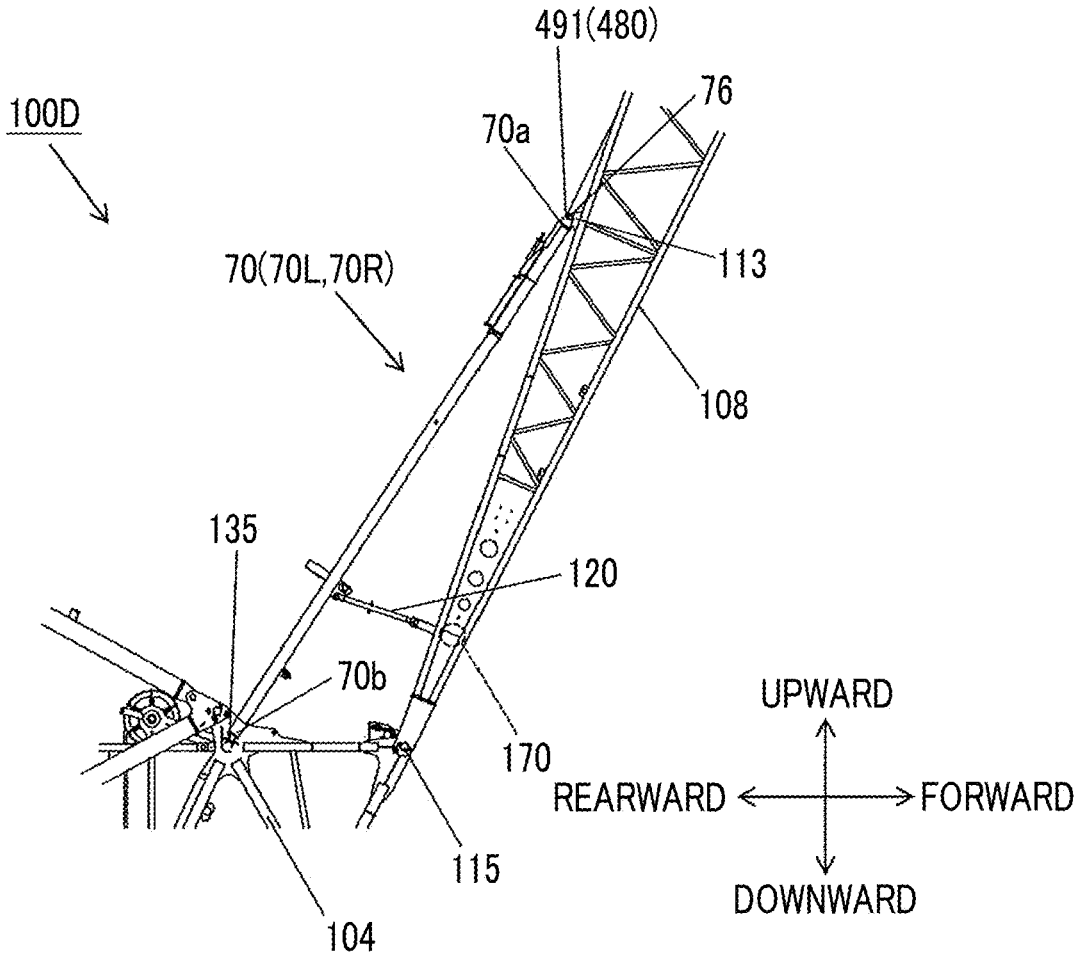
FIG. 18 is a side view illustrating a configuration of a jib backstop operation detection device according to a fourth embodiment.

A configuration of a crane 100D according to a fourth embodiment is different from the configuration of the third embodiment in that a pin-type load cell (load sensor) 491 is used instead of the wire-type displacement meter 391 in order to detect the operation of the jib backstop 70. That is, the jib backstop operation detection device 480 according to the fourth embodiment is configured to include the pin-type load cell 491. Hereinafter, points different from those according to the third embodiment will be mainly described. FIG. 18 is a side view illustrating the configuration of the jib backstop operation detection device 480 according to the fourth embodiment.

As illustrated in FIG. 18, the pin-type load cell 491 (load sensor/hereinafter, abbreviated as the load cell 491) for detecting a load acting on the pin 76 is incorporated in the pin 76. The load cell 491 detects a change in the load acting on the pin 76 as the other end 70*b* of the jib backstop 70 comes into contact with the target 135. According to the fourth embodiment, based on the change in the load, it is determined whether the jib backstop 70 is in contact with the target 135 or whether the jib 108 pivots at a maximum standing angle (upper limit angle).

Figure 19:
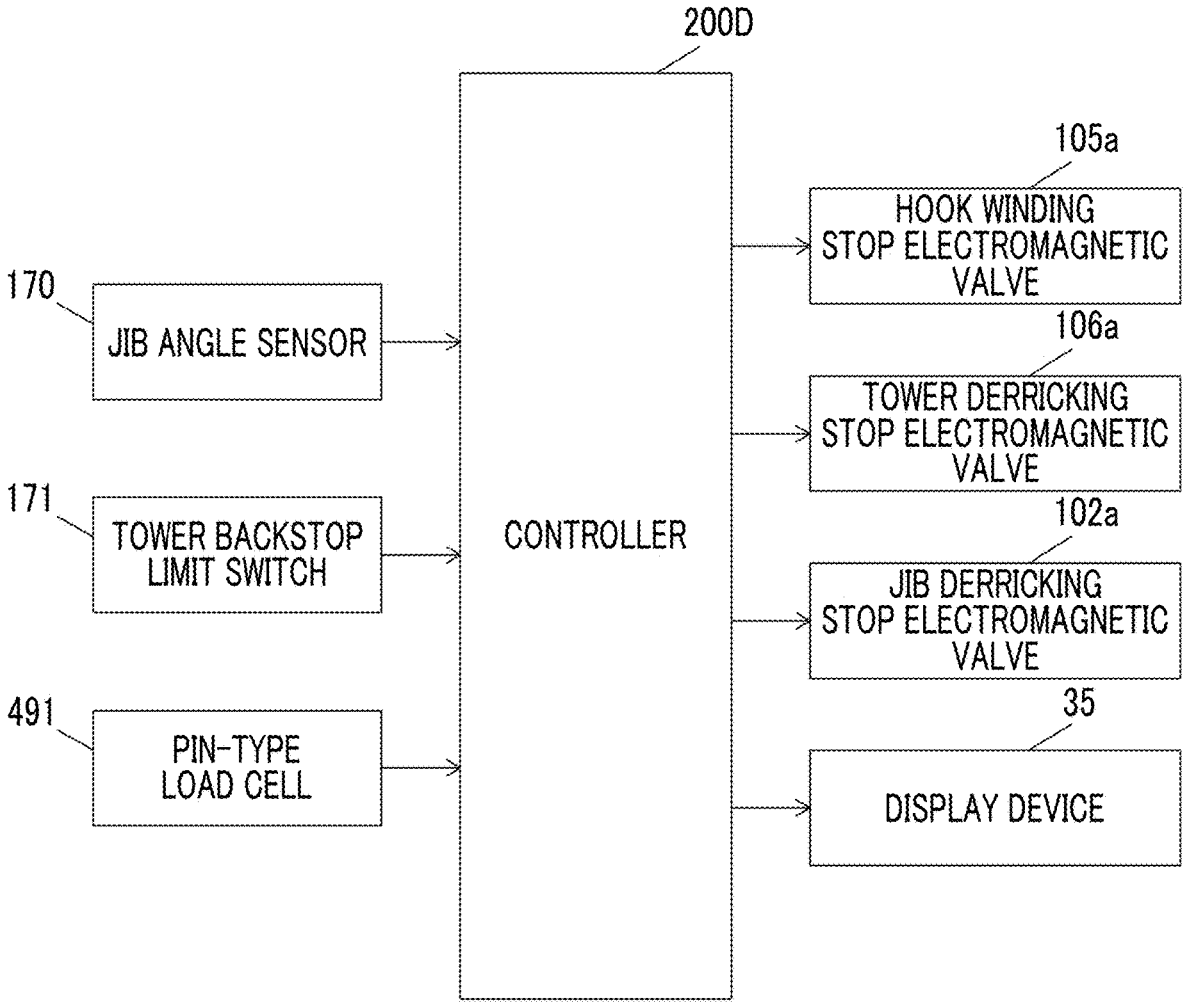
FIG. 19 is a block diagram illustrating an input to and an output from a controller.

The configuration will be described in detail with reference to FIGS. 19 and 20. FIG. 19 is a block diagram illustrating an input to and an output from a controller 200D. The controller 200D according to the fourth embodiment is a control device for controlling each part of the crane 100D. Although not illustrated, the controller 200D includes a CPU for performing various calculations, a memory serving as a storage device, a communication interface, and other peripheral devices.

As illustrated in FIG. 19, each detection signal is input to the controller 200D from the jib angle sensor 170 for detecting an angle of the jib 108, the limit switch 171 for detecting an operation of the tower backstop 50, the load cell 491 for detecting an operation of the jib backstop 70, and other sensors (not illustrated). The output side of the controller 200D is the same as that according to the third embodiment.

Figure 20:
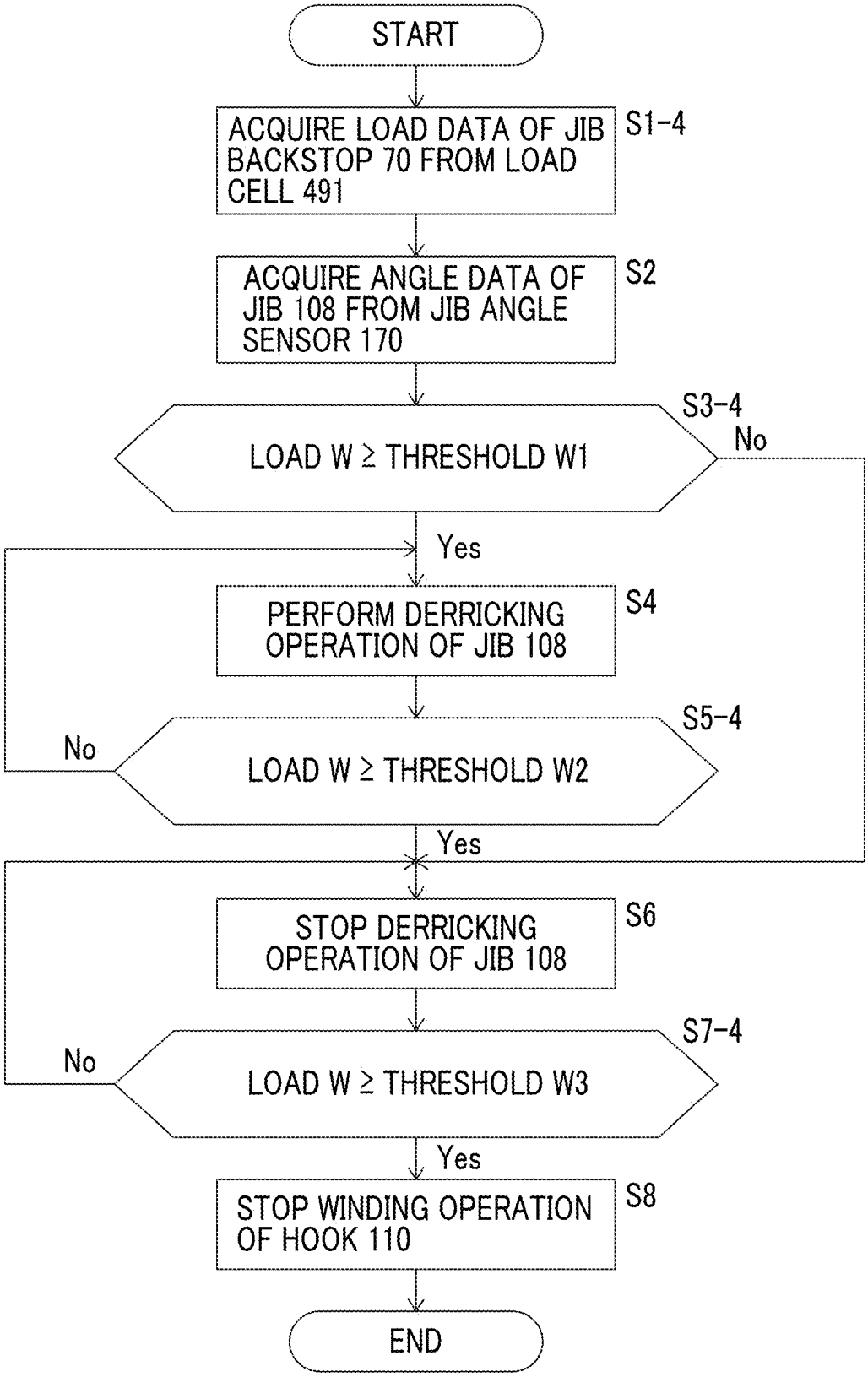
FIG. 20 is a flowchart illustrating a control procedure of a derricking operation of the jib which is performed by the controller.

FIG. 20 is a flowchart illustrating a control procedure of the derricking operation of the jib 108 according to the fourth embodiment. As illustrated in FIG. 20, the controller 200D acquires load data of the jib backstop 70 from the load cell 491 (Step S1-4), and acquires angle data of the jib 108, based on the detection signal from the jib angle sensor 170 (Step S2). Next, the controller 200D determines whether or not a load W of the jib backstop 70 is a threshold W1 or greater (Step S3-4). In a case where the load W is the threshold W1 or greater (Step S3-4/Yes), the controller 200D performs the derricking operation of the jib 108 (Step S4). Here, the threshold W1 is used in order to determine whether or not the other end 70*b* of the jib backstop 70 is reliably in contact with the target 135. For example, the threshold W1 is set in advance to a load value acting on the pin 76 in a case where the jib backstop 70 shrinks as much as a displacement amount L1 (refer to FIG. 10B).

Next, if the controller 200D determines that the load W is a threshold W2 or greater (Step S5-4/Yes), the controller 200D operates the jib derricking stop electromagnetic valve 102*a* so as to stop the derricking operation of the jib 108 (Step S6). Here, for example, the threshold W2 is set in advance to a load value acting on the pin 76 in a case where the jib backstop 70 shrinks as much as a displacement amount L1+L4 (refer to FIG. 10B).

In a case where the controller 200D determines that the load W is smaller than the threshold W1 (S3-4/No) in the determination process in Step S3-4, the controller 200D proceeds to Step S6 so as to stop the derricking operation of the jib 108, and notifies the display device 35 of a fact that the operation is abnormal. In this manner, the jib 108 is prevented from performing the standing operation in a state where the jib backstop 70 is not in contact with the target 135.

In a case where the controller 200D determines that the load W is a threshold W3 or greater (S7-4/Yes), the controller 200D operates the hook winding stop electromagnetic valve 105*a* so as to stop the winding operation of the hook 110 (Step S8), and completes the process. Here, for example, the threshold W3 is set in advance to a load value acting on the pin 76 in a case where the jib backstop 70 shrinks as much as a displacement amount L2 (refer to FIG. 10B).

In this way, similarly to the third embodiment, according to the fourth embodiment, the crane 100D can also be safely operated even if the jib 108 or the backstop 70 malfunctions. Moreover, the load cell 491 is used instead of the displacement meter 391. Therefore, the configuration of the jib backstop operation detection device 480 can be simplified, and can be inexpensively manufactured.

Fifth Embodiment

A configuration of a crane 100E according to a fifth embodiment is different from the configuration according to the first to fourth embodiments in that a jib backstop operation detection device 580 for detecting whether or not the jib backstop 70 is in contact with a target (contact plate) 535 is disposed in the target 535 instead of the jib backstop 70. Specifically, according to the fifth embodiment, instead of detecting the stretching operation of the jib backstop 70, an upward-downward operation of the target 535 is detected so as to determine whether or not the jib backstop 70 is reliably in contact with the target 535.

Figure 21:
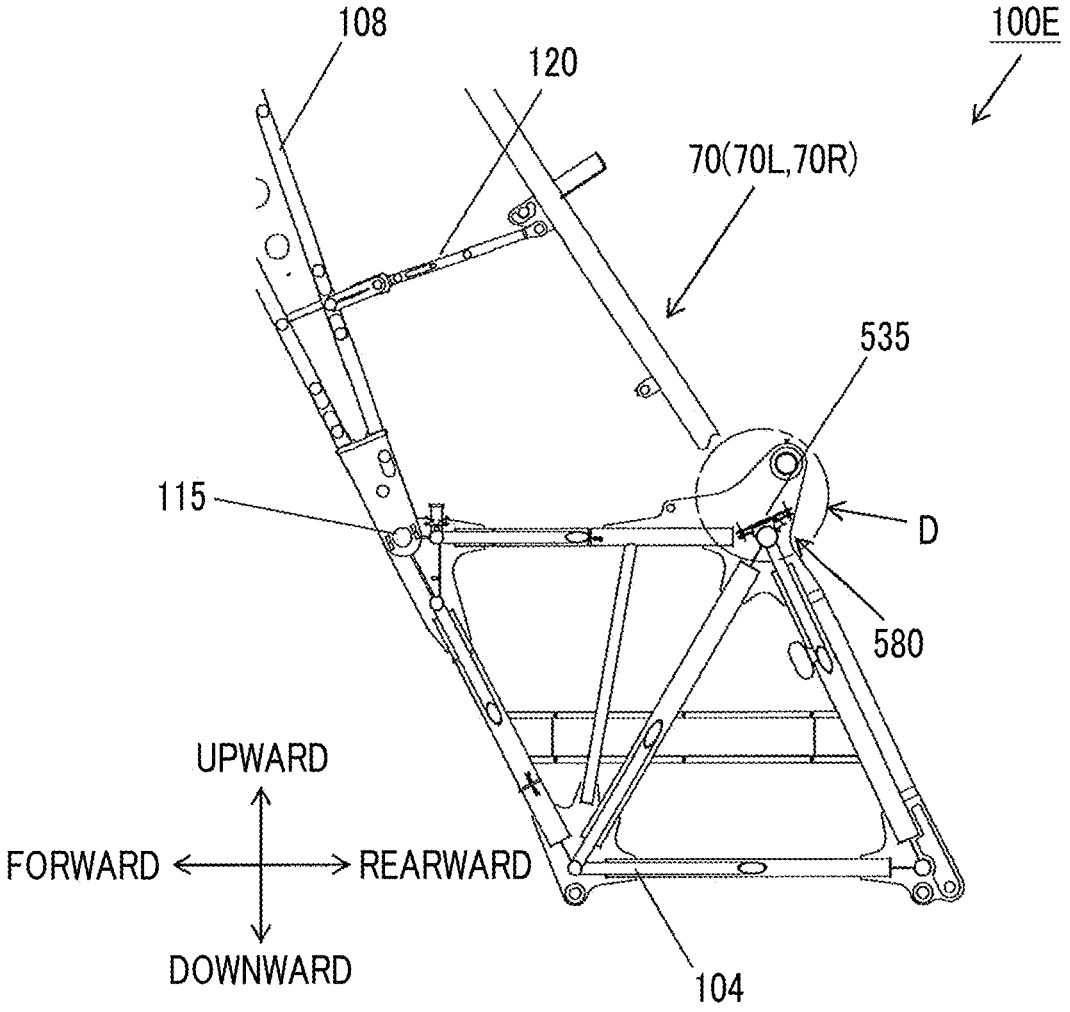
FIG. 21 is a side view illustrating a main part near a target of a tower crane according to a fifth embodiment.
Figures 22A, 22B:
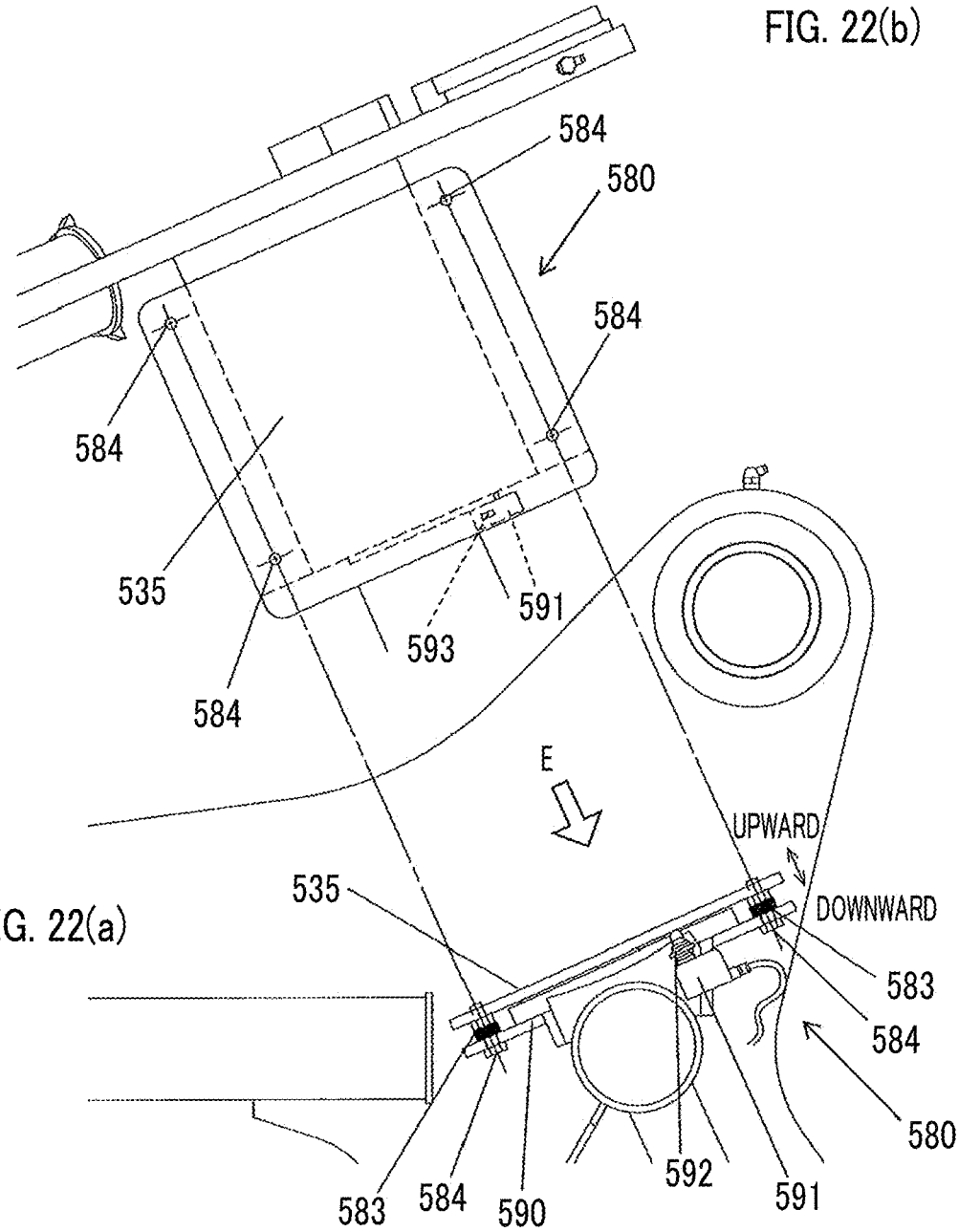
FIG. 22(*a*) is an enlarged view of a part D in FIG. 21, and FIG. 22(*b*) is a view taken along an arrow E.

Referring to FIGS. 21, 22(*a*), and 22(*b*), a configuration of the jib backstop operation detection device 580 according to the fifth embodiment will be described. FIG. 21 is a side view illustrating a main part near the target 535 of the crane 100E according to the fifth embodiment. FIG. 22(*a*) is an enlarged view of a part D in FIG. 21, and FIG. 22(*b*) is a view taken along an arrow E in FIG. 22(*a*).

As illustrated in FIGS. 21, 22(*a*), and 22(*b*), according to the fifth embodiment, the jib backstop operation detection device 580 is disposed in the target 535. According to the fifth embodiment, the jib backstop operation detection device 580 includes a base plate 590 to which a target limit switch 591 (third limit switch/hereinafter, abbreviated as a limit switch 591) is attached, four coned disk springs (biasing members) 583 disposed at four corners between the base plate 590 and the target 535, and four guide pins 584 to be inserted into the respective coned disk springs 583.

The target 535 is formed of a square plate, is biased upward by the coned disk spring 583, and is held at a predetermined interval from the limit switch 591 disposed in the base plate 590. In other words, the limit switch 591 is disposed at a position separated downward from the target 535 as the predetermined interval. Here, the predetermined interval is preferably set to such a distance which enables the limit switch 591 to detect that the jib backstop 70 is reliably in contact with the target 535, and can be set to a displacement difference L1, for example (refer to FIG. 10B). The target 535 is configured to be movable in the upward-downward direction with respect to the base plate 590 while being guided by the guide pin 584.

If the jib 108 performs the standing operation to the position P1 from the position P1 where the other end 70*b* of the jib backstop 70 starts to come into contact with the target 535 (refer to FIG. 10A), in accordance with the standing operation of the jib 108, the other end 70*b* of jib backstop 70 presses the target 535 downward. In this case, the target 535 is moved downward as much as a displacement amount L1 (third displacement amount) against the biasing force of the coned disk spring 583, and presses down the roller 592 of the limit switch 591 so that the limit the contact of the limit switch 591 is closed and an ON-signal is output to the controller 200E. The ON-signal (operation signal) is input from the limit switch 591, thereby enabling the controller 200E to detect that the jib backstop 70 is reliably in contact with the target 535.

In this way, according to the fifth embodiment, the target 535 is pressed by the jib backstop 70 from an initial position where the jib backstop 70 is not in contact with the target 535. When the jib backstop 70 reaches the third position where the jib backstop 70 is moved as much as the displacement amount L1 (third displacement amount), the limit switch 591 is configured to be turned on.

Figure 23:
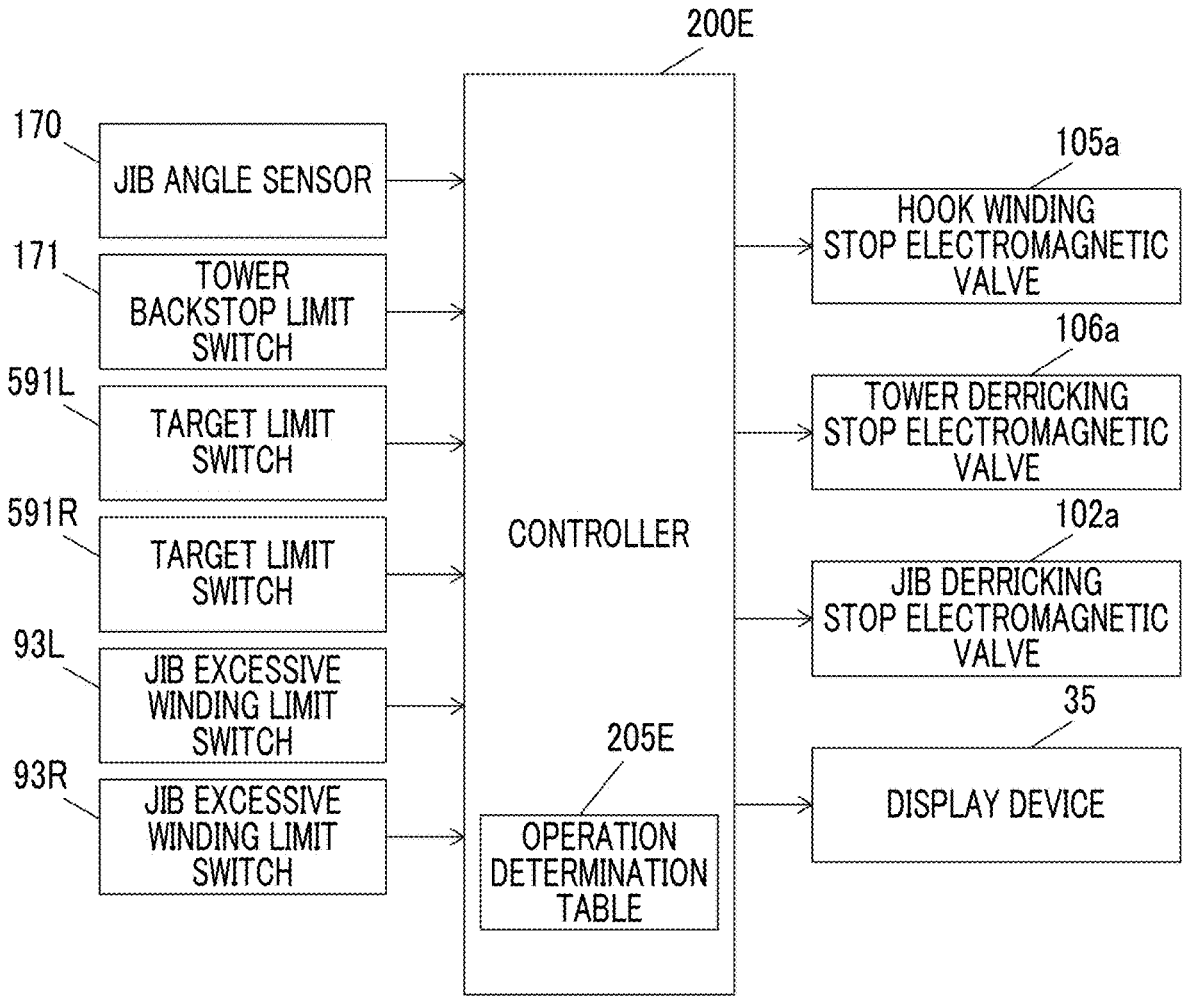
FIG. 23 is a block diagram illustrating an input to and an output from a controller.

Next, a configuration of the controller 200E mounted on the crane 100E will be described. FIG. 23 is a block diagram illustrating an input to and an output from the controller 200E. The controller 200E according to the fifth embodiment is different from that according to the first embodiment in that limit switches 591L and 591R are connected to the input side instead of the limit switches 91L and 91R. The output side is the same as that according to the first embodiment. As will be described later, a configuration of an operation determination table 205E stored in a memory is different from that according to the first embodiment.

Figure 24:
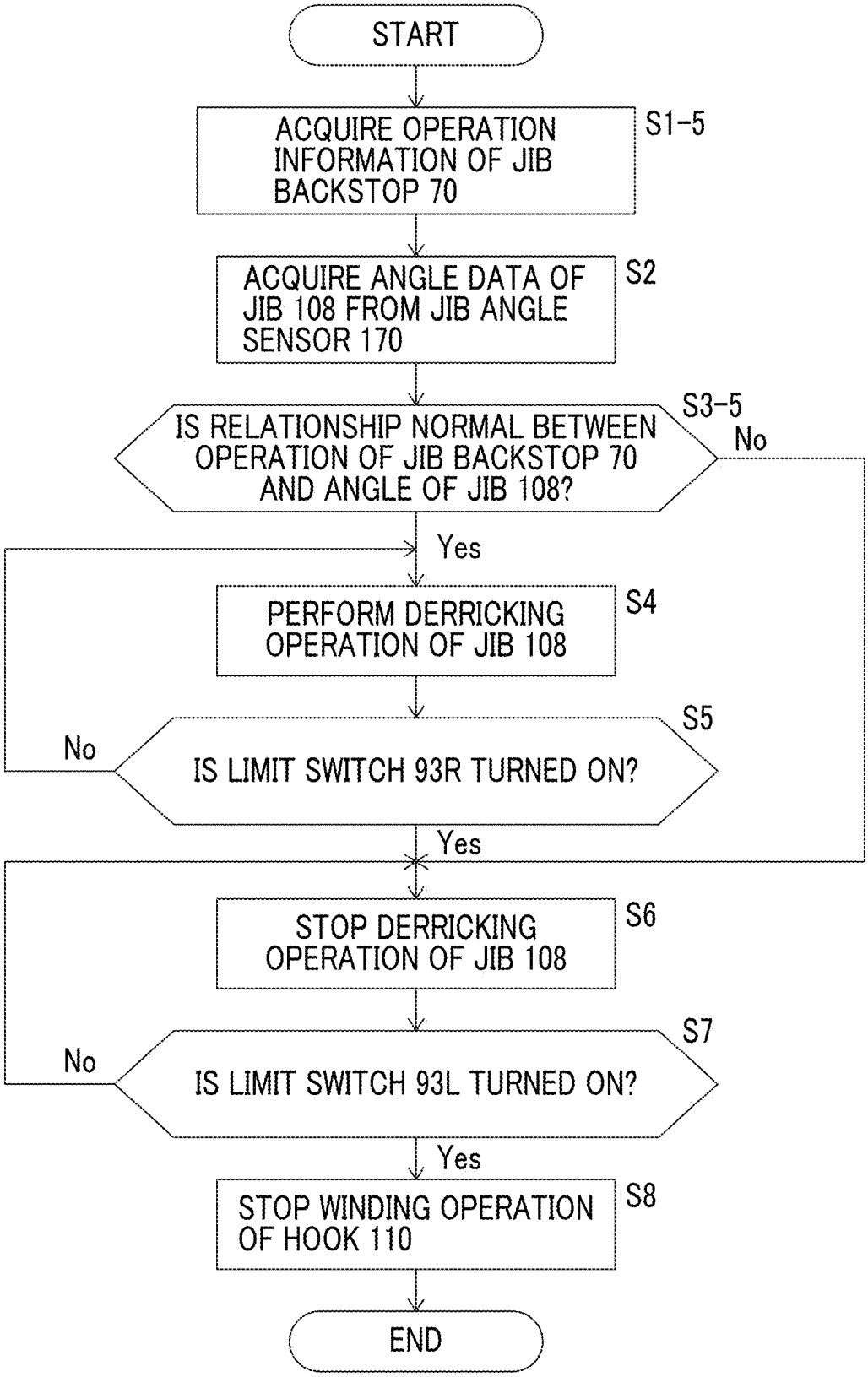
FIG. 24 is a flowchart illustrating a control procedure of a derricking operation of the jib which is performed by the controller.

Next, the control of the derricking operation of the jib 108 which is performed by the controller 200E will be described. FIG. 24 is a flowchart illustrating a control procedure of the derricking operation of the jib 108 which is performed by the controller 200E. As illustrated in FIG. 24, if the derricking operation of the jib 108 starts, the controller 200E acquires operation information of the jib backstop 70, based on an operation signal output from the limit switch 591 (Step S1-5), and acquires angle data of the jib 108, based on the detection signal from the jib angle sensor 170 (Step S2). Next, the controller 200E determines whether a relationship is normal between the operation of the jib backstop 70 and the angle of the jib 108 (Step S3-5). The operation determination table 205E for determining whether or not the operation of the jib backstop 70 is normal is stored in a memory of the controller 200E.

FIG. 25 is a view illustrating the operation determination table 205E which stipulates whether or not the operation of the jib backstop 70 is normal. The operation determination table 205E illustrated in FIG. 25 stipulates whether or not the operation of the jib backstop 70 is normal based on the jib angle θ and the limit switches 591L and 591R. Specifically, in a case where the angle (jib angle) θ of the jib 108 is smaller than 65°, and in a case where both the limit switches 591L and 591R are turned off, it is stipulated that the operation of the jib backstop 70 is "normal". In a case where the jib angle is 65° or larger, and only in a case where both the limit switches 591L and 591R are turned on, it is stipulated that the operation of the jib backstop 70 is "normal. In a case where at least any one of the limit switches 591L and 591R is turned off, it is stipulated that the operation of the jib backstop 70 is "abnormal".

In a case where the controller 200E determines that the operation is normal in the operation determination process in Step S3-5 (S3-5/Yes), the controller 200E performs the derricking operation of the jib 108 (Step S4). In a case where the controller 200E determines that the operation is abnormal (S3-5/NO) in the operation determination process in Step S3-5, the controller 200E proceeds to Step S6 so as to stop the derricking operation of the jib 108. In this manner, the jib 108 is prevented from performing the standing operation in a state where the jib backstop 70 is not in contact with the target 135. The subsequent process is the same as that according to in the first embodiment. Accordingly, the description will be omitted here.

In this way, similarly to the first to fourth embodiments, according to the fifth embodiment, the derricking operation of the jib 108 can also be performed by detecting that the jib backstop 70 surely is reliably in contact with the target 535. Accordingly, the crane 100E can be safely operated. According to the fifth embodiment, a configuration is adopted in which the jib backstop operation detection device 580 is disposed in the target 535. Accordingly, it is not necessary to improve the jib backstop 70 in the related art. That is, the crane in the related art can be more safely operated merely by installing the jib backstop operation detection device 580 according to the fifth embodiment in the target of the existing crane.

The present invention is not limited to the above-described embodiments, and can be modified in various ways within the scope not departing from the gist of the present invention. All of the technical matters included in the technical concept described in the appended claims are objects of the present invention. Although the above-described embodiments are preferred examples, those skilled in the art can realize various substitutes, corrections, modifications, or improvements, based on the contents disclosed in the specification, and these are included in the technical scope described in the appended claims.

For example, although not illustrated, a configuration may be adopted as follows. The jib backstop operation detection device includes a strain gauge for detecting distortion of the target 135, and the controller determines that the angle of the jib 108 is a predetermined angle (for example, 65°) or larger, based on the detection signal from the jib angle sensor 170. In a case where the distortion of the target 135 is smaller than a predetermined threshold, based on a detection signal output from the strain gauge, the controller stops the standing operation of the jib 108.

In the respective embodiments described above, a configuration may be adopted. One end 70*a* of the jib backstop 70 is the free end, and the other end 70*b* is pivotally supported by the tower 104. In this case, the target 135 is disposed in the jib 108. In the first embodiment and the second embodiment, the positions of the limit switch 91L and the limit switch 91R in the forward-rearward direction of may not necessarily be the same as each other. In this case, it may be determined that the jib backstop 70 is normal in a case where both the limit switches 91L and 91R are turned on. The operation of the jib backstop 70 may be determined by monitoring only the limit switch disposed forward between the limit switches 91L and 91R. In a case where the limit switch disposed forward is turned on, it can be considered that the limit switch disposed rearward is also turned on.

In the third embodiment and the fourth embodiment, the jib backstop operation detection devices 380 and 480 may include the limit switch 93 in order to prevent the jib from being excessively wound.

In the respective embodiments described above, a configuration has been described in which the derricking operation of the jib 108 is controlled, based on the operation signal which switches the contacts of the limit switches 91 and 93 from OFF to ON. However, the derricking operation of the jib 108 maybe controlled, based on the operation signal which switches the contacts of the limit switches 91 and 93 from ON to OFF.

The embodiment has been described in which the operation of the jib backstop 70 is detected so as to control the derricking operation of the jib 108. However, according to the present invention, the operation of the tower backstop 50 can be detected so as to control the derricking operation of the tower 104. Alternatively, the present invention is applicable to various types of cranes in addition to the tower crane.

It should be understood that the invention is not limited to the above-described embodiment, but may be modified into various forms on the basis of the spirit of the invention. Additionally, the modifications are included in the scope of the invention.

What is claimed is:

1. A crane comprising:

a front member capable of derricking;

a backstop disposed on a rear surface side of the front member so as to limit a standing operation of the front member;

an angle sensor that detects an angle of the front member;

an operation detection unit that detects whether or not the backstop is operated; and a controller that controls a derricking operation of the front member, wherein in a case where the controller determines that the angle of the front member is equal to or larger than a predetermined angle, based on a detection signal output from the angle sensor, and determines that the backstop is not operated, based on a detection signal output from the operation detection unit, the controller stops the standing operation of the front member.

2. The crane according to claim 1, wherein one end of the backstop is supported, and the other end of the backstop is free end, wherein the backstop comprises a contact portion with which the other end of the backstop comes into contact in accordance with the standing operation of the front member, wherein the operation detection unit detects whether or not the other end of the backstop is in contact with the contact portion, wherein the controller determines that the angle of the front member is equal to or larger than the predetermined angle, based on the detection signal output from the angle sensor, and wherein the controller stops the standing operation of the front member in a case where it is determined that the other end of the backstop is not in contact with the contact portion, based on the detection signal output from the operation detection unit.

3. The crane according to claim 2, wherein the operation detection unit includes a first moving member which moves in conjunction with a stretching operation of the backstop and a first limit switch which detects that the first moving member is moved to a first position, wherein if the front member further performs the standing operation as much as a first pivot angle from a contact position where the other end of the backstop starts to come into contact with the contact portion, the backstop shrinks as much as a first displacement amount, wherein if the backstop shrinks as much as the first displacement amount, the first moving member is moved to the first position, wherein the controller determines that the angle of the front member is equal to or larger than the predetermined angle, based on the detection signal output from the angle sensor, and wherein the controller stops the standing operation of the front member in a case where it is determined that the first moving member is not moved to the first position, based on a detection signal output from the first limit switch.

4. The crane according to claim 3, wherein the first pivot angle falls within a range of 1° to 5°.

5. The crane according to claim 3, wherein the operation detection unit further includes a second moving member which moves in conjunction with the stretching operation of the backstop and a second limit switch which detects that the second moving member is moved to a second position, wherein if the front member performs the standing operation as much as a second pivot angle larger than the first pivot angle from the contact position, the backstop shrinks as much as a second displacement amount larger than the first displacement amount, wherein if the backstop shrinks as much as the second displacement amount, the second moving member is moved to the second position, and wherein the controller stops the standing operation of the front member in a case where the controller determines that the second moving member is moved to the second position, based on a detection signal output from the second limit switch.

6. The crane according to claim 5, wherein the first moving member and the second moving member are integrated so as to form one moving member, and wherein the first limit switch and the second limit switch are disposed at an interval as much as a distance between the first position and the second position along a moving direction of the moving member.

7. The crane according to claim 1, wherein a plurality of sets of the backstop and the operation detection unit are provided, wherein the controller determines that the angle of the front member is equal to or larger than the predetermined angle, based on the detection signal output from the angle sensor, and wherein the controller stops the standing operation of the front member in a case where it is determined that at least one of the backstop is not operated, based on the detection signal output from the operation detection unit.

8. The crane according to claim 7, wherein the plurality of operation detection units are respectively arrayed in parallel with each other on the rear surface of the front member, and are disposed at the same position in a forward-rearward direction.

9. The crane according to claim 1, wherein the operation detection unit includes a displacement meter which detects a displacement of the stretching operation of the backstop, wherein the controller determines that the angle of the front member is equal to or larger than the predetermined angle, based on the detection signal output from the angle sensor, and wherein the controller stops the standing operation of the front member in a case where a displacement amount of the backstop which is detected by the displacement meter is smaller than a first threshold.

10. The crane according to claim 1, wherein the operation detection unit includes a load sensor which detects a load acting on the backstop, wherein the controller determines that the angle of the front member is equal to or larger than the predetermined angle, based on the detection signal output from the angle sensor, and wherein the controller stops the standing operation of the front member in a case where a magnitude of the load is smaller than a second threshold, based on a detection signal output from the load sensor.

11. The crane according to claim 1, wherein one end of the backstop is supported, and the other end of the backstop is free end, wherein the backstop comprises a contact plate with which the other end comes into contact in accordance with the standing operation of the front member, wherein the operation detection unit includes a biasing member which biases the contact plate upward and a third limit switch which detects the contact plate moves downward to a third position against a biasing force of the biasing member, wherein if the front member further performs the standing operation as much as a first pivot angle from a contact position where the other end of the backstop starts to come into contact with the contact plate, the backstop shrinks as much as a third displacement amount, wherein if the backstop shrinks as much as the third displacement amount, the contact plate is moved to the third position, wherein the controller determines that the angle of the front member is equal to or larger than the predetermined angle, based on the detection signal output from the angle sensor, and wherein the controller stops the standing operation of the front member in a case where it is determined that the contact plate is not moved to the third position, based on a detection signal output from the third limit switch.

* * * * *